US007811152B2

(12) United States Patent
McEntyre et al.

(10) Patent No.: US 7,811,152 B2
(45) Date of Patent: Oct. 12, 2010

(54) FOOD CHEWING ASSEMBLY FOR DOLL

(75) Inventors: Richard McEntyre, Baldwin, GA (US); Sally Segalla McEntyre, Baldwin, GA (US); Gerald Ray London, Cleveland, GA (US)

(73) Assignee: Original Appalachian Artworks, Inc., Cleveland, GA (US)

( * ) Notice: Subject to any disclaimer, the term of this patent is extended or adjusted under 35 U.S.C. 154(b) by 135 days.

(21) Appl. No.: 12/324,539

(22) Filed: Nov. 26, 2008

(65) Prior Publication Data

US 2010/0130095 A1 May 27, 2010

(51) Int. Cl.
*A63H 3/24* (2006.01)

(52) U.S. Cl. ..... 446/304; 446/297

(58) Field of Classification Search ..... 446/133, 446/139, 140, 296, 297, 304, 320, 330, 351, 446/395; 198/619, 472.1, 805
See application file for complete search history.

(56) References Cited

U.S. PATENT DOCUMENTS

| | | | | |
|---|---|---|---|---|
| 1,440,487 | A | | 1/1923 | Newell |
| 1,751,773 | A | | 3/1930 | Trosper |
| 2,185,190 | A | | 1/1940 | Gorbea et al. |
| 2,530,032 | A | | 11/1950 | Schier et al. |
| 2,531,912 | A | | 11/1950 | Kahn |
| 2,688,208 | A | | 9/1954 | Bannister |
| 2,856,729 | A | | 10/1958 | Clintsman |
| 3,005,283 | A | | 10/1961 | Cohn |
| 3,153,881 | A | | 10/1964 | Baulard-Cogan |
| 3,186,126 | A | | 6/1965 | Ostrander |
| 3,195,269 | A | | 7/1965 | Weih et al. |
| 3,202,423 | A | | 8/1965 | Becker |
| 3,229,421 | A | | 1/1966 | Ostranger |
| 3,234,688 | A | | 2/1966 | Neumann et al. |
| 3,261,124 | A | | 7/1966 | Bodenstein |
| 3,394,494 | A | | 7/1968 | Gardel et al. |
| 3,641,703 | A | * | 2/1972 | Tepper et al. ..... 446/295 |
| 3,775,901 | A | | 12/1973 | Ellman et al. |
| 3,924,351 | A | | 12/1975 | Terzian |
| 4,192,092 | A | | 3/1980 | Goldfarb et al. |
| 4,244,139 | A | | 1/1981 | Erickson et al. |
| 4,504,241 | A | | 3/1985 | Dyson et al. |
| 4,565,536 | A | | 1/1986 | Vairo |
| 5,037,345 | A | | 8/1991 | Nakayama |
| 5,083,962 | A | | 1/1992 | Pracas |
| 5,250,003 | A | * | 10/1993 | Ferre ..... 446/301 |
| 5,713,778 | A | | 2/1998 | Radosevich et al. |
| 6,042,450 | A | | 3/2000 | Leversedge et al. |
| 7,040,951 | B2 | | 5/2006 | Hornsby et al. |

* cited by examiner

*Primary Examiner*—Nini Legesse
(74) *Attorney, Agent, or Firm*—Ballard Spahr LLP

(57) ABSTRACT

Provided is an assembly for moving a selectively magnetized article. The assembly has a conduit having an inlet and an outlet and defining a lumen extending from the inlet to the outlet. A magnetic source is selectively positioned proximate an exterior surface of the conduit and transmits a magnetic field into the lumen to magnetically engage at least a portion of the selectively magnetized article. The assembly is configured to attract the selectively magnetized article through the inlet and move the article through the lumen toward the outlet. The assembly can be positioned within a doll with the inlet of the assembly positioned proximate a mouth of the doll. The assembly can include means for articulating a lower lip of the doll to simulate chewing of the selectively magnetized article when the article is inserted into the mouth of the doll.

28 Claims, 17 Drawing Sheets

FOOD CHEWING ASSEMBLY FOR DOLL

FIELD OF THE INVENTION

Provided is an assembly for moving a selectively magnetized article, such as a simulated food-shaped article, through a conduit. More specifically, an exemplary assembly can be positioned within a doll that is configured for simulating the chewing of the food-shaped article, and for moving the selectively magnetized article through at least a portion of the doll.

BACKGROUND

For children's enjoyment, toy manufacturers have created dolls and the like having various interactive features, such as moving parts, sound effects, etc. In the past, dolls have been created that mimic or simulate various human or animal actions and behaviors, such as drinking, eating, excreting, walking, and crying, among others. Adding such features to dolls often requires the inclusion of mechanical, electrical, or electromechanical components. Many of these components may be partially or completely exposed and can cause significant dangers to the users of the dolls, such as children. For instance, a child's hair, fingers, clothing, etc., can be snagged or caught by a mechanical or electromechanical component and cause the child injury.

Thus, there is a need in the art for dolls and the like that simulate selected human and animal actions without exposing a user, such as a child, to danger or injury.

SUMMARY

In one aspect, assemblies are provided for moving a selectively magnetized article. In a further aspect, the assemblies can be configured for moving the selectively magnetized article through a portion of a doll and to simulate the chewing and ingesting of the selectively magnetized article which can, in one aspect, simulate a food article. An exemplary assembly, in one aspect, can comprise a conduit having a wall having an exterior surface and an inner surface, an inlet, and an outlet. The inner surface of the wall can define a lumen extending between the inlet and the outlet. An exemplary assembly can also comprise at least one magnetic source configured to transmit a magnetic field into at least a portion of the lumen and magnetically engage at least a portion of the selectively magnetized article. Means for moving the at least one magnetic source can be provided. The exemplary assembly can be configured to attract the selectively magnetized article through the inlet when the selectively magnetized article is placed in magnetic proximity of the inlet. The exemplary assembly can be further configured to move the selectively magnetized article through at least a portion of the lumen toward the outlet.

According to further aspects, the inner surface of the outlet can be substantially continuous from the inlet to the outlet. In this aspect, the at least one magnetic source can be selectively positioned exterior to the conduit. The means for moving the at least one magnetic source can also be selectively positioned exterior to the conduit.

In yet another aspect, a doll is provided for simulating eating of a selectively magnetized article. The doll can comprise a head portion having a mouth, and a body portion connected to the head portion. An exemplary assembly can be positioned therein the doll. The exemplary assembly can comprise a conduit having an inlet and an outlet. The assembly can be positioned in the doll such that the inlet is positioned proximate the mouth of the doll.

Additional advantages of the invention will be set forth in part in the description that follows, and in part will be obvious from the description or may be learned by practice of the aspects described herein. It is to be understood that both the foregoing general description and the following detailed description are exemplary and explanatory only and are not restrictive of aspects of the invention, as claimed.

BRIEF DESCRIPTION OF THE DRAWINGS

The accompanying drawings, which are incorporated in and constitute a part of this specification, illustrate several aspects of the invention and, together with the description, serve to explain the principles of the invention.

DETAILED DESCRIPTION

Figure 1:
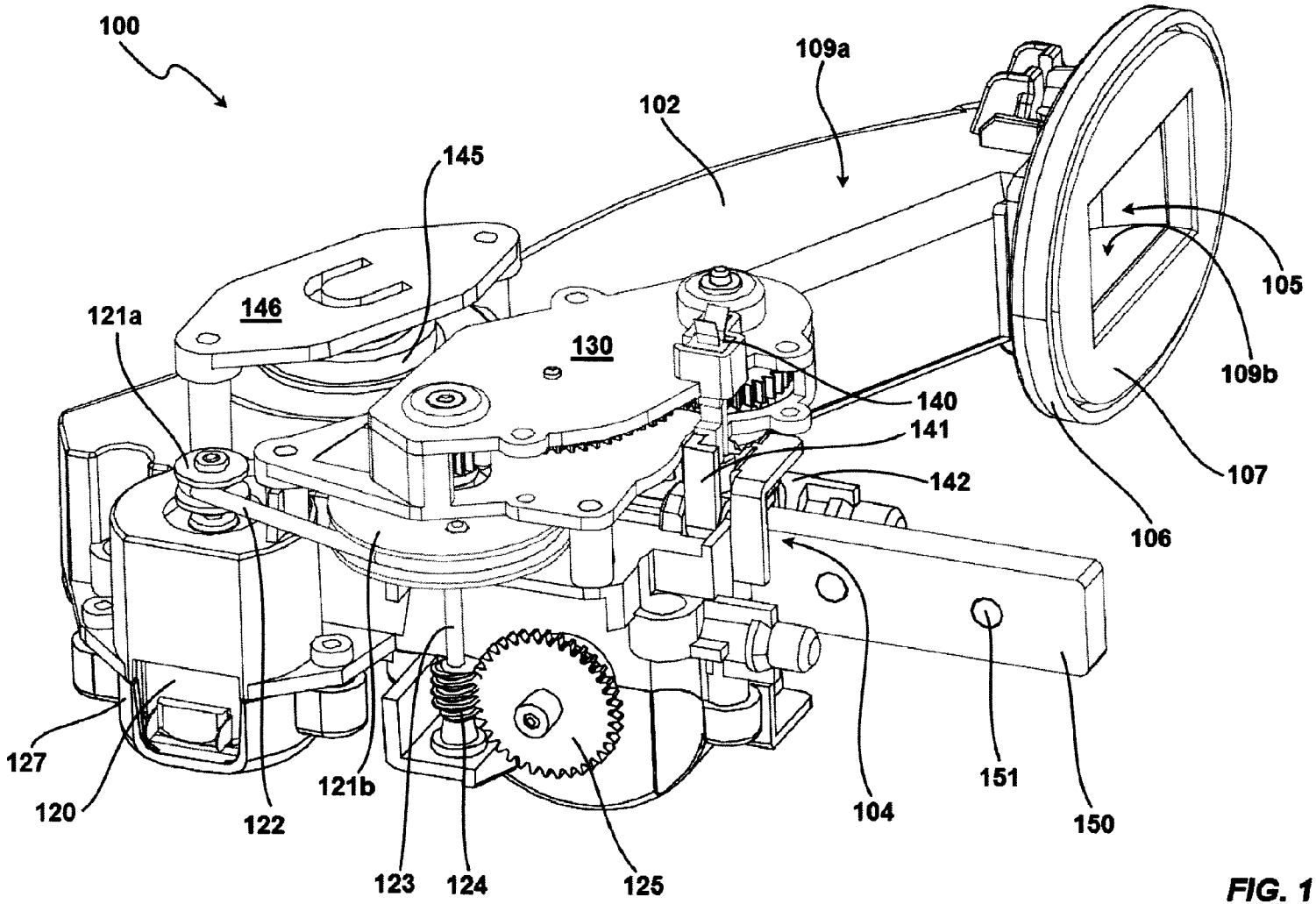
FIG. 1 is a schematic diagram showing a first perspective view of an assembly for moving a selectively magnetized article, according to one aspect.

The present invention may be understood more readily by reference to the following detailed description, drawings, and claims, and their previous and following description. However, before the present devices, assemblies, systems, and/or methods are disclosed and described, it is to be understood that the aspects described herein are not limited to the specific devices, assemblies, systems, and/or methods disclosed unless otherwise specified, as such can, of course, vary. It is also to be understood that the terminology used herein is for the purpose of describing particular aspects only and is not intended to be limiting.

As used in the specification and the appended claims, the singular forms "a," "an" and "the" include plural referents unless the context clearly dictates otherwise. Thus, for example, reference to a "selectively magnetized article" can include two or more such selectively magnetized articles unless the context indicates otherwise.

Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

As used herein, the terms "optional" or "optionally" mean that the subsequently described event or circumstance can or cannot occur, and that the description includes instances where said event or circumstance occurs and instances where it does not.

The term "doll," as used herein, is intended to include any toy or similar article, whether or not it is intended for being played with by children, which may have human or animal characteristics. A doll can also refer to a toy or similar article that has characteristics of a surreal creature, such as a monster, Martian, or other creature. A doll can include a stuffed animal, figurine, mannequin, marionette, puppet, or soft-sculptured toy, among others. Thus, the term "doll," as used herein, is not meant to be limiting.

The terms "magnetized" and "magnetic," and derivations thereof as used herein, are intended to refer to items that exhibit the properties of a magnet, as well as items that are capable of being magnetized or being attracted by a magnet. Thus, the terms "magnetized" and "magnetic" are not meant to be limiting.

Reference will now be made in detail to the present preferred aspects of the invention, examples of which are illustrated in the accompanying drawings. Wherever possible, the same reference numbers are used throughout the drawings to refer to the same or like parts.

In one aspect, an assembly is provided for moving a selectively magnetized article. With reference to FIGS. 1-6, an exemplary assembly 100, in one aspect, can comprise a conduit 102 comprising a wall 101 having an exterior surface 109*a* and an inner surface 109*b*, an inlet 104 and an opposed outlet 105. The inner surface of the conduit defines a lumen 108 extending between the inlet and outlet. In one aspect, the conduit can define a generally linear lumen. Optionally, the conduit can define a generally non-linear lumen, such as an arcuate lumen, or the lumen can have any other shape. According to various aspects, the conduit can define a lumen having any shape, which may be dependent on the need or desire to have the inlet and the outlet in specific respective positions.

As described further herein below, the conduit can be configured to receive the selectively magnetized article 150 therein the inlet 104 and to move the selectively magnetized article through at least a portion of the lumen 108 toward the outlet 105. For example, the assembly can be configured to attract the selectively magnetized article therethrough the inlet 104 when the selectively magnetized article is placed in magnetic proximity of the inlet, and to move the selectively magnetized article through at least a portion of the lumen toward the outlet.

In one aspect, the assembly comprises at least one magnetic source. The at least one magnetic source can be positioned proximate the exterior surface 109*a* of the conduit 102. According to a further aspect, the magnetic source can be positioned proximate the inlet 104 of the conduit. The magnetic source can be configured to transmit a magnetic field into at least a portion of the lumen 108. The magnetic source is thus configured to magnetically engage at least a portion of the selectively magnetized article, as described further herein. According to one aspect, that at least one magnetic source can be selectively positioned exterior to the conduit.

Figure 8A:
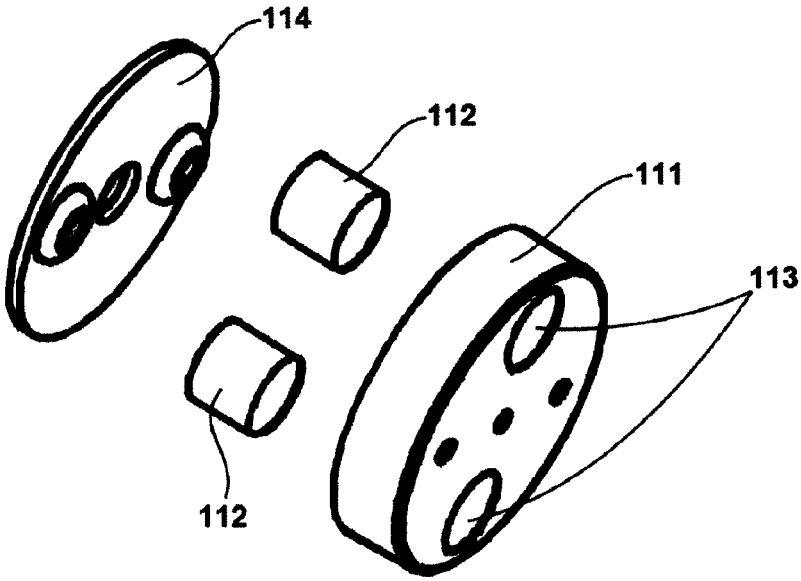
FIG. 8A is a schematic diagram showing a disk and magnets configured for insertion therein the disk.
Figure 8B:
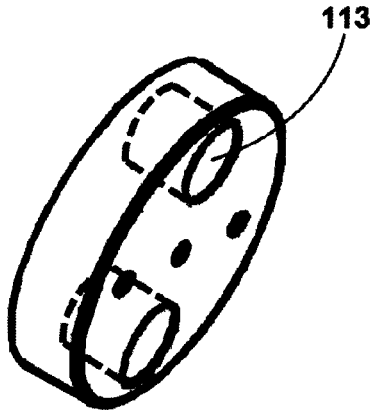
FIG. 8B is a schematic diagram showing the disk of FIG. 8A with the magnets inserted therein the disk.

The at least one magnetic source, in one aspect, comprises at least one magnetic portion. For example, according to one aspect, such as illustrated in FIGS. 8A and 8B, the at least one magnetic source can comprise a disk 111, at least a portion of which can be magnetic. For example, as illustrated in FIG. 8A, the disk can be substantially cylindrical having a longitudinal axis and an upper, substantially planar upper surface that lies in a plane that is perpendicular to the longitudinal axis. One or more bores 113 can be formed in the disk 111 and can extend from the upper surface of the disk in a direction parallel to the longitudinal axis. In one aspect, the one or more bores can be blind bores and can extend only partially into the disk; optionally, the bores can extend fully through the disk. According to yet another aspect, it is contemplated that the one or more bores can be formed in the disk at a radial distance from the longitudinal axis, such that the one or more bores are not concentric with the disk. Although shown in FIG. 8A as having two bores 113, it is contemplated that a disk can have one bore, two bores, or more than two bores, and is not intended to be limited.

According to a further aspect, the at least one magnetic source can further comprise at least one magnet positioned therein the disk. For example, a magnet 112 can be placed therein a respective bore of the disk. As shown in FIGS. 8A and 8B, for example, two bores 113 can be formed in the disk 111 and a respective magnet 112 can be positioned in each of the bores. Because the one or more bores are not concentric with the disk, in one aspect, the at least one magnet can be positioned in the disk such that a center of the at least one magnet lies at a radial distance from the longitudinal axis of the disk. In one aspect, such as shown in FIGS. 8A and 8B, two magnets can be provided. Each magnet can be positioned at a radial distance from the longitudinal axis of the disk along a common diameter of the disk, on opposing sides of the longitudinal axis.

It is contemplated that each magnet can be shaped to be complementarily received by a respective bore. For example, as shown in FIGS. 8A and 8B, the bores can be substantially cylindrical and the magnets can likewise be substantially cylindrical. The magnets can also have a substantially planar upper surface. According to a further aspect, it is contemplated that when the magnets are placed within the respective bores, the substantially planar upper surfaces of the magnets will be substantially co-planar with the substantially planar upper surface of the disk. In one aspect, the magnets can be retained within the bores of the disk through adhesive means. Optionally, the magnets can be retained within the bores of the disk through a friction fit. In yet another aspect, such as shown in FIG. 8A, the bores can be formed within the disk so that the opening of the bores formed at the upper surface of the disk can have a slightly smaller diameter than the diameter of the magnets. The magnets can be inserted into the bores from the bottom of the disk, and a retaining plate 114 can be attached to the bottom of the disk to retain the magnets within the bores.

While generally described herein as magnets placed therein the disk, it is contemplated that pieces of metal (such as a ferrous metal) can be placed therein the disk, which are capable of being attracted by a magnet (such as, but not limited to, a magnet disposed therein the selectively magnetized article). In yet another aspect, it is contemplated that the substantially cylindrical disk can be formed around the magnets such that the magnets will be embedded in the disk. For example, the disk can be formed of a plastic material; the magnet(s) can be placed in a mold for the disk, and the plastic material can be poured into the mold and allowed to harden or cure around the magnets, thereby embedding the magnets in the disk. As can be appreciated, the method of manufacturing the disk and positioning the magnets therein the disk is not intended to be limited to the methods described herein.

Figure 6:
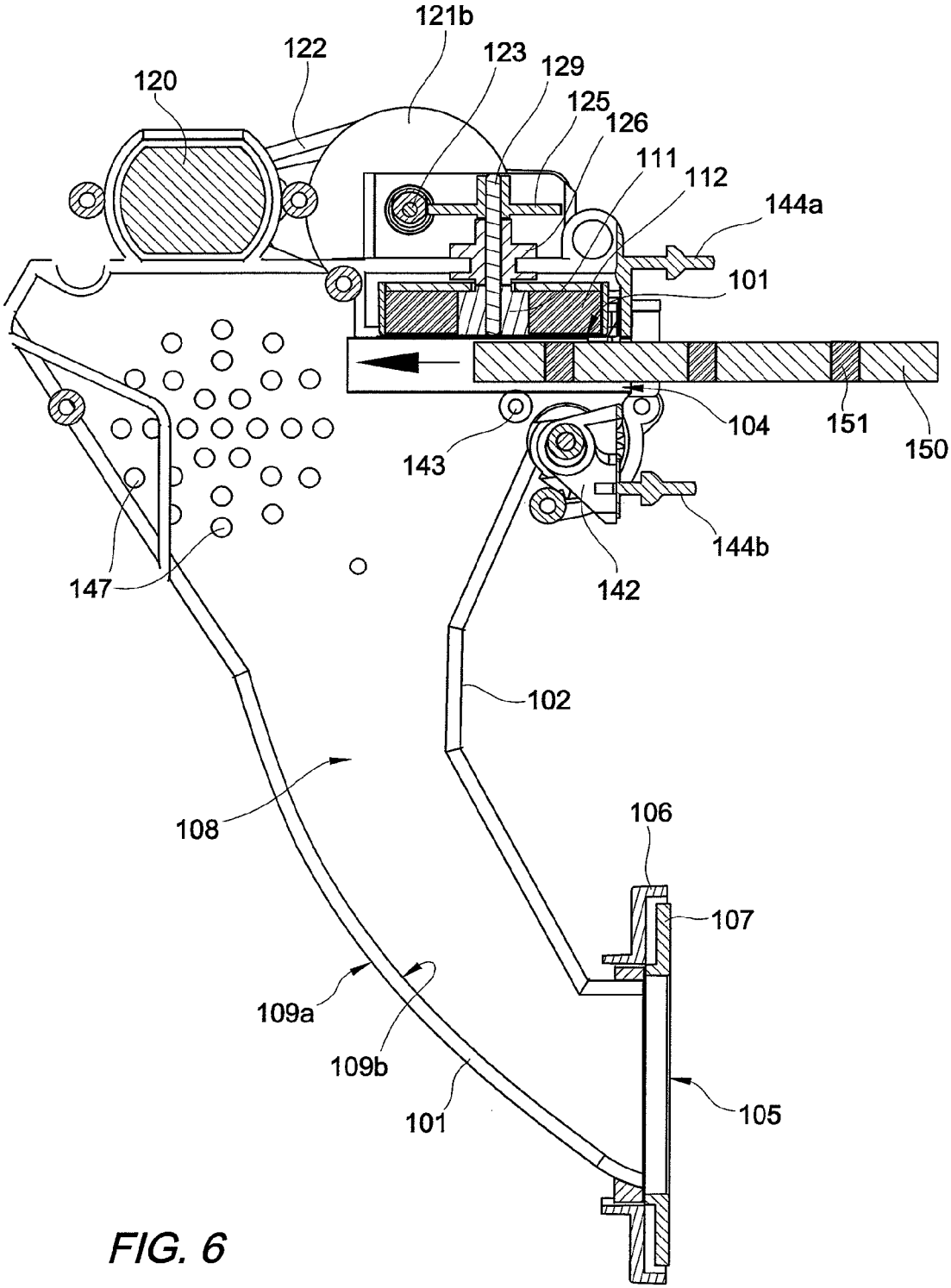
FIG. 6 is a schematic diagram showing a side cross-sectional view of the assembly of FIG. 1, taken along line A-A of FIG. 5.

In one aspect, such as shown in FIG. 6, the disk can be positioned proximate a portion of the exterior surface of the conduit, such as a portion of the exterior surface that is proximate the inlet 104. As described above, according to various aspects, the at least one magnetic source, such as the disk, can be selectively positioned exterior to the conduit. According to one aspect, the disk 111 can be positioned proximate the inlet with the substantially planar upper surface of the disk lying in a plane that is substantially perpendicular to a plane defined by the inlet, such as shown in FIG. 6 for example. In other words, the disk can be positioned such that the longitudinal axis of the disk is substantially perpendicular to the plane defined by the inlet.

As shown in FIG. 6, in one aspect, the conduit can be shaped to house the disk; in this aspect, however, a portion of the wall 101 of the conduit can extend between the upper surface of the disk (shown as the bottom of the disk when viewed in FIG. 6) and the lumen 108. The portion of the wall that extends between the upper surface of the disk and the lumen can be formed from the same material as the remainder of the wall of the conduit. The portion of the wall can have the same thickness as the remainder of the wall, or can have a different thickness. Optionally, the portion of the wall that extends between the upper surface of the disk and the lumen can be formed from another material and can have the same or a different thickness as the remainder of the wall. According to a particular aspect, the portion of the wall that extends between the upper surface of the disk and the lumen can be formed from a separate piece of material from the remainder of the wall. This piece of material can be positioned to be continuous with the remainder of the wall and can be held in place by one or more retaining members (such as retaining members 135*a*, 135*b* shown in FIG. 7). In a further aspect, after the piece of material is positioned, it can be sealed or adhered to the remainder of the wall to ensure that the inner surface of the conduit is substantially continuous from the inlet to the outlet. In one aspect, the thickness of the portion of the wall that extends between the disk and the lumen can be selected to allow the at least one magnetic source to transmit a magnetic field into at least a portion of the lumen. The thickness, in one aspect, can be selected from the range of about 0.1 millimeters to about 10 millimeters, such as 0.1 mm, 0.2 mm, 0.3 mm, 0.4 mm, 0.5 mm, 1 mm, 1.5 mm, 2 mm, 3 mm, 4 mm, 5 mm, 6 mm, 7 mm, 8 mm, 9 mm, or 10 mm.

As shown in FIG. 6, the disk can be positioned proximate the upper portion of the inlet 104 (i.e., above the lumen when viewed in FIG. 6), such that when the selectively magnetized article 150 is inserted therethrough the inlet, the disk is above the selectively magnetized article. Optionally, however, the disk can be positioned proximate the lower portion of the inlet, or proximate side portions of the inlet. According to yet another aspect, the disk or other magnetic source can be positioned at least partially within the wall of the conduit. According to a particular aspect, the conduit can have a substantially rectangular cross-section proximate the inlet, such as can be appreciated from viewing the front view of the assembly in FIG. 3A. The disk can be positioned above the lumen such that the substantially planar upper surface of the disk is adjacent to—although not necessarily in contact with—the exterior surface of the wall of the conduit, such as shown in FIG. 6.

According to a further aspect, the assembly 100 can comprise means for moving the at least one magnetic source proximate at least a portion of the exterior surface 109*a* of the conduit 102. As described above, the at least one magnetic source has at least one magnetic portion. In one aspect, the means for moving the at least one magnetic source can be configured to urge or move the magnetic portion from a first position proximate the inlet toward a second position spaced from the inlet. According to one exemplary aspect, the means for moving the at least one magnetic source can be configured to rotate the disk 111 about its longitudinal axis to move the at least one magnet to and through a first position proximate the inlet and a second position spaced from the inlet.

Figure 2:
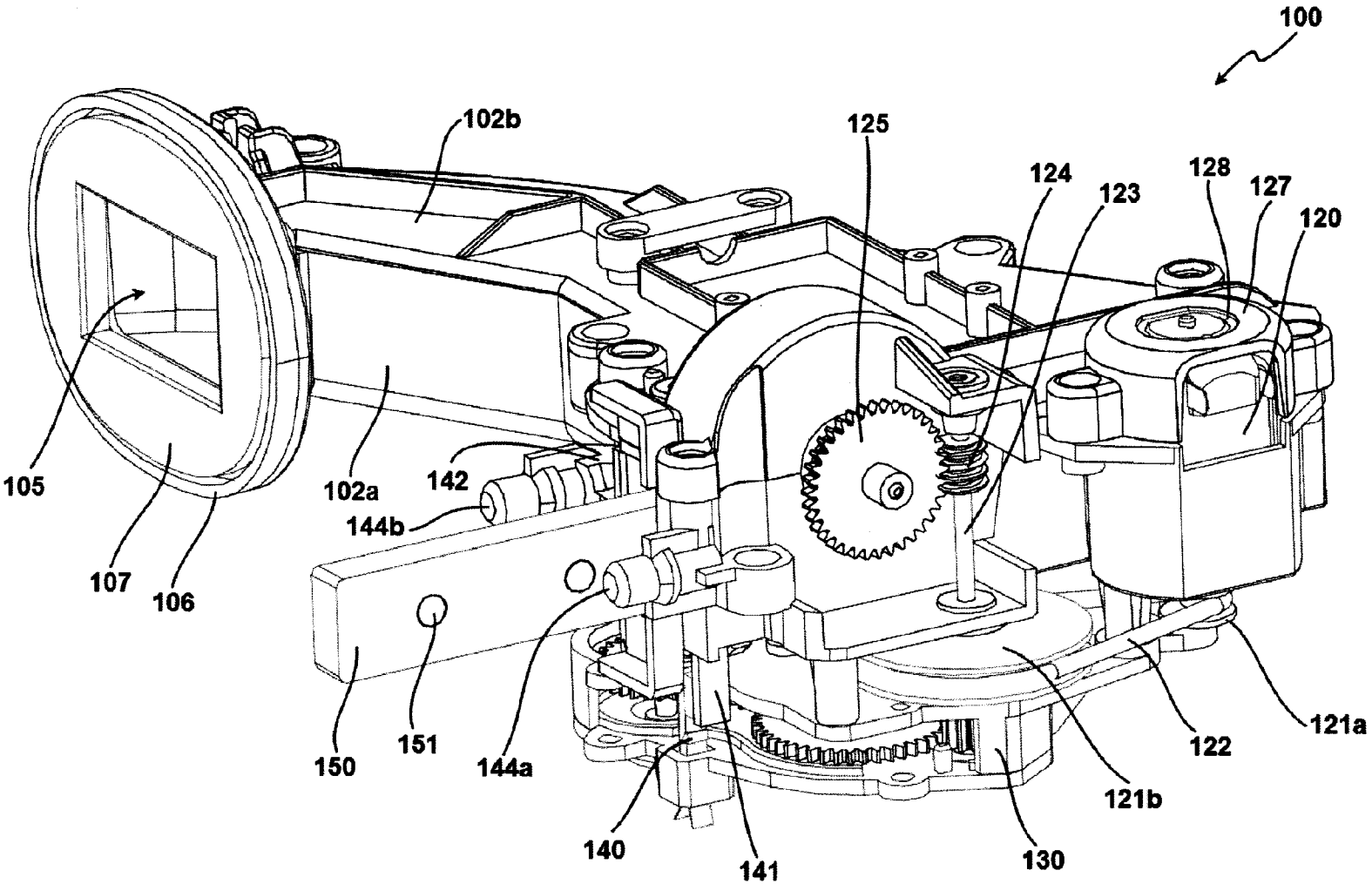
FIG. 2 is a schematic diagram showing a second perspective view of the assembly of FIG. 1.

According to one aspect, and with reference to FIGS. 1-6, for example, a motor 120 can be provided and can be in operative communication with the at least one magnetic source, such as but not limited to the disk 111 described above. As shown in FIG. 2, the motor can be mounted to the conduit with a motor mount 127. A motor pad 128 can be positioned between the motor and the motor mount, such as to dampen vibrations produced when the motor is operating. As illustrated in FIG. 1, the motor 120 can be operatively connected to the disk via a series of pulleys and/or gears. A motor shaft can extend from the motor, and a first pulley 121*a* can be attached to (e.g., mounted on) the distal end of the motor shaft. A second pulley 121*b*, spaced from the first pulley, can be operatively connected to the first pulley via a belt 122. The second pulley 121*b* can be mounted on the proximal end portion of a drive shaft 123. A worm gear 124 can be mounted on or attached to the distal end of the drive shaft. The worm gear can be in geared connection to a main gear 125. As shown in FIG. 6, the main gear can be mounted on a respective main gear shaft 129 that extends through a disk shaft 126 and through the disk 111.

Thus, as can be appreciated, as the motor operates, it causes the motor shaft to rotate, thereby effecting the rotation of the first pulley 121*a* and the second pulley 121*b*, by way of the belt 122. As the second pulley 121*b* rotates, it causes the drive shaft 123 and the worm gear 124 to rotate, thereby effecting the rotation of the main gear 125 and the main gear shaft 129. The rotation of the main gear thus causes the disk 111 to rotate. It is contemplated that various means can be provided to transmit the power of the motor to move the magnetic source, such as the disk, and the particular arrangement of pulleys and gears as exemplarily shown in FIGS. 1-6 is not intended to be limiting.

Figure 3A:
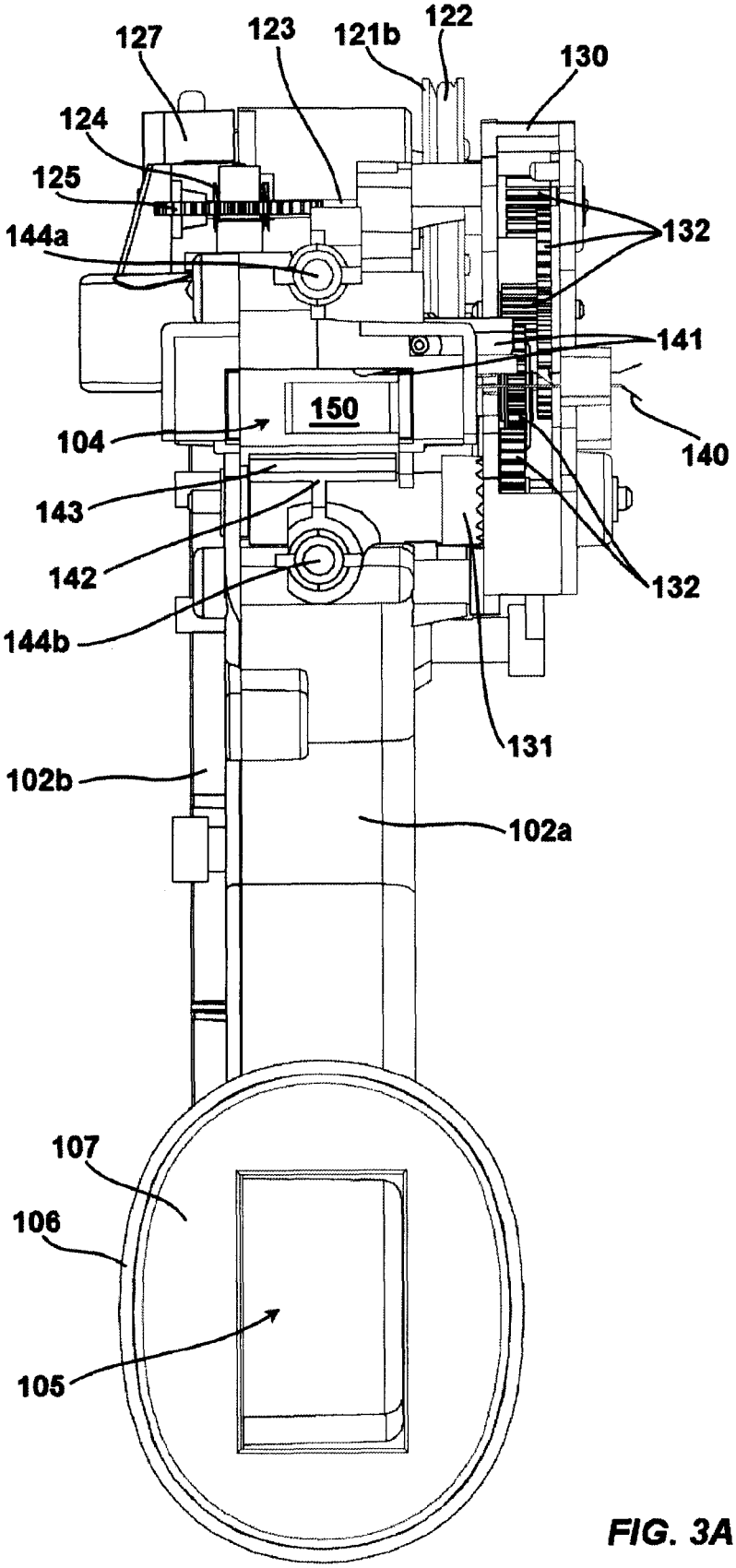
FIG. 3A is a schematic diagram showing a front view of the assembly of FIG. 1.

As described above and as shown in FIG. 6 for example, the disk can be positioned above the lumen with the upper surface adjacent to (although not necessarily in contact with) the exterior surface of the conduit. When the motor is activated, it causes the disk to begin rotating about its longitudinal axis, as described above. As can be seen in FIGS. 2 and 3A, the longitudinal axis of the disk (which is coaxial with the main gear shaft 129) can be positioned toward the side of the lumen, proximate a side wall portion of the conduit. Thus, it is contemplated that approximately half of the disk 111 can extend across the top of the lumen at any given point in its rotation. In one aspect, as described above and as shown in FIG. 8B, two magnets 112 can be positioned within the disk substantially along a common diameter of the disk. Thus, it is contemplated that at any given point in the rotation of the disk, at least a portion of at least one of the magnets is positioned above the lumen and is configured to transmit a magnetic field into the lumen. The disk can be configured to rotate in a predetermined direction such that as the disk rotates, the at least one magnet moves along or proximate the exterior surface of the conduit in a direction away from the inlet. For example, as viewed in the top view of FIG. 5, the disk can rotate in a counter-clockwise direction. However, as can be appreciated, if the disk is positioned on the other side of the lumen, the disk can be configured to rotate in a clockwise direction. Thus, when the at least one magnet engages at least a portion of the selectively magnetized article, described further below, the selectively magnetized article can be drawn into the lumen (such as in the direction of the arrow shown in FIG. 6).

According to various aspects, the assembly 100 can further comprise a switch mechanism configured to sense the selectively magnetized article when a portion of the selectively magnetized article is inserted through the inlet into the lumen. In response to sensing the selectively magnetized article, the switch mechanism can be configured to activate one or more components of the assembly. For example, in one aspect, the switch mechanism can be configured to activate the means for moving the at least one magnetic source in response to sensing the selectively magnetized article. The switch mechanism can, in one aspect, activate the motor in response to sensing the selectively magnetized article. The motor can, in turn, cause the disk to begin rotating.

Figure 7:
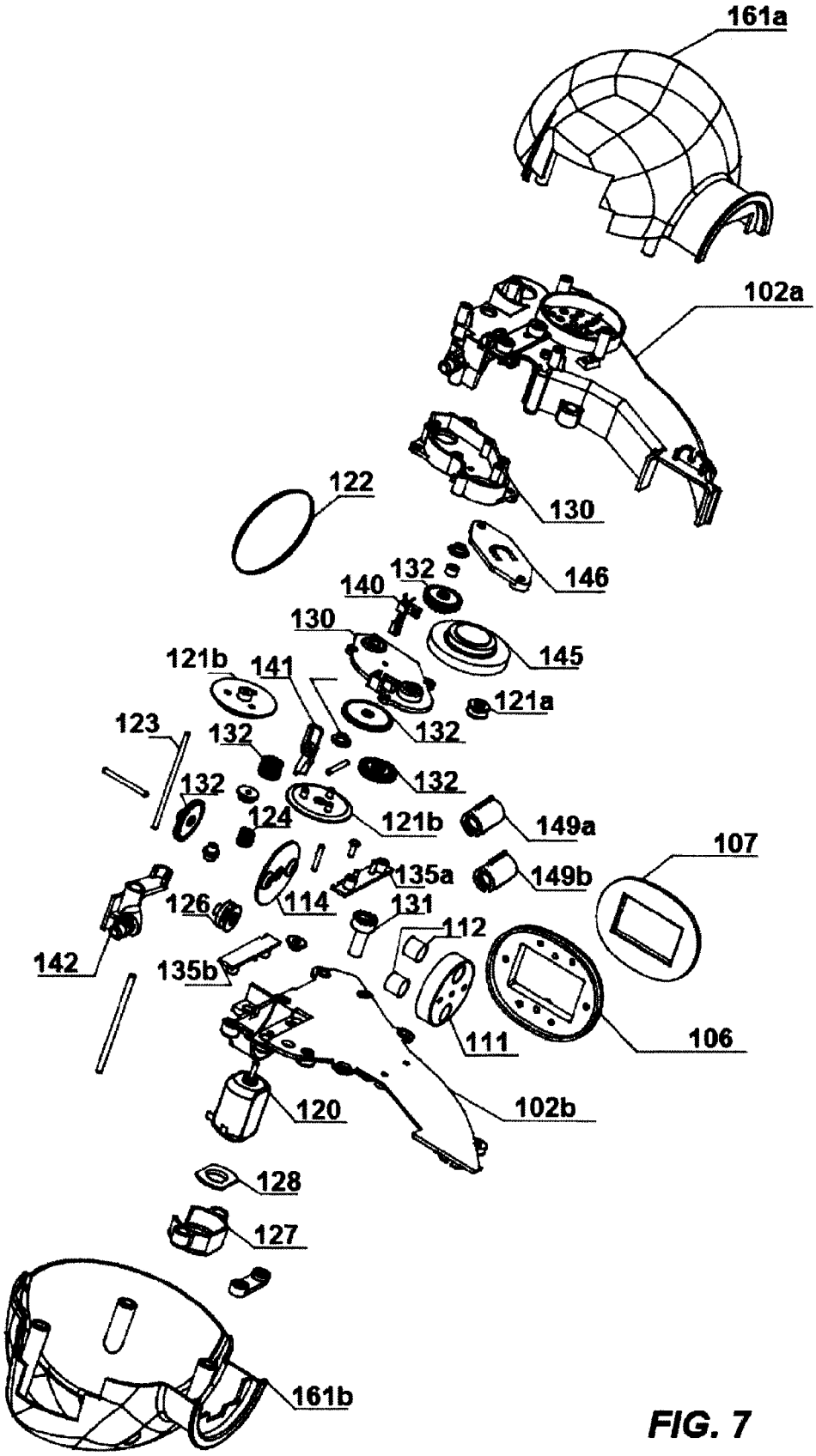
FIG. 7 is an exploded view of an exemplary assembly for moving a selectively magnetized article.

The switch mechanism, in one aspect, can extend at least partially into the lumen proximate the inlet. As illustrated in FIGS. 1-7, the switch mechanism can comprise a mouth activating lever 141 and a switch 140. As shown in FIG. 7, the mouth activating lever 141 can comprise a first arm and a second arm, both of which extend from a common pivot point. As shown in FIG. 3A, a portion of the first arm extends into the lumen proximate the inlet, when the switch mechanism is in its resting position. Likewise, in the resting position, the second arm rests above the switch 140. The switch can be, in one aspect, a leaf switch. As can be appreciated by those skilled in the art, the leaf switch can comprise two metal strips which, in a non-activated or resting position, are not in contact with each other. As shown in FIG. 3A for example, the two metal strips can be positioned below the second arm of the mouth activating lever. When the first arm of the mouth activating lever 141 is contacted, such as by the selectively magnetized article being inserted into the lumen, the first arm will raise upwards (as viewed in FIG. 3A). The mouth activating lever will pivot about its pivot point, causing the second arm to move downwards and cause the metal strips of the switch 140 to come into contact with each other, thereby completing the circuit in the switch (or "tripping" the switch). The switch thus activates the motor and/or other electrical or electromechanical components of the assembly. Other switches can likewise be used, such as magnetically-tripped switches, sensors, or other known switch or sensing means.

As described above, the assembly is configured to attract the selectively magnetized article therethrough the inlet and move the selectively magnetized article through at least a portion of the lumen toward the outlet. After the selectively magnetized article has been attracted completely into the lumen, past the switch, the first arm of the mouth activating lever 141 can move downward and relieve the pressure of the second arm on the switch, thereby breaking the circuit and inactivating the motor and/or other electrical or electromechanical components. In yet another aspect, the assembly can be configured to allow the motor to operate for a specific period of time after the switch has been tripped initially. For example, a timer can be provided that is configured to deactivate the motor after a certain time period has elapsed from the initial tripping of the switch. The time period, in one aspect, can be sufficiently long to allow the selectively magnetized article to pass through all or a portion of the lumen. According to yet another aspect, a second switch or switch mechanism can be positioned within the lumen downstream from the inlet and can be tripped when the selectively magnetized article passes through the lumen, thereby deactivating the motor. Optionally, a user of the assembly can manually and selectively activate the motor and/or other electromechanical component using an on/off switch.

As shown in FIG. 6, the assembly can comprise a roller 143 positioned proximate the inlet 104, but at a spaced distance from the inlet. The roller can be positioned at a spaced distance from the disk 111, such that the selectively magnetized article will pass into the lumen in between the disk and the roller 143. The roller can allow the selectively magnetized article to move into the lumen in a linear fashion for a specified distance, prior to dropping (when viewed in FIG. 6, for example) and passing through the lumen toward the outlet. In this manner, the magnetic engagement between the at least one magnetic source and the selectively magnetized article can be maximized and can thus ensure that the selectively magnetized article is fully drawn into the lumen by the at least one magnetic source.

Figure 3B:
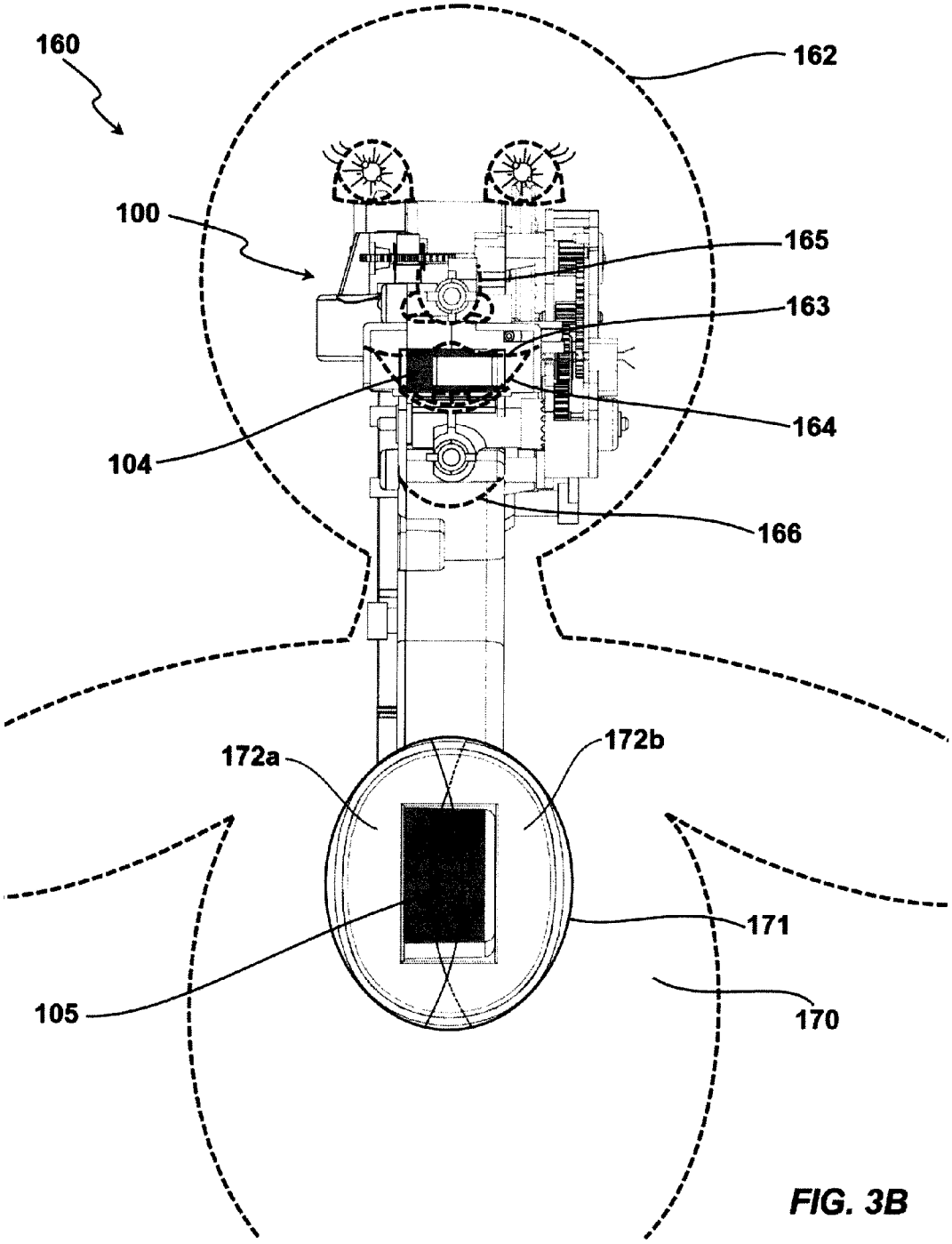
FIG. 3B is a schematic diagram showing a front view of the assembly of FIG. 1 positioned within a doll.
Figure 4A:
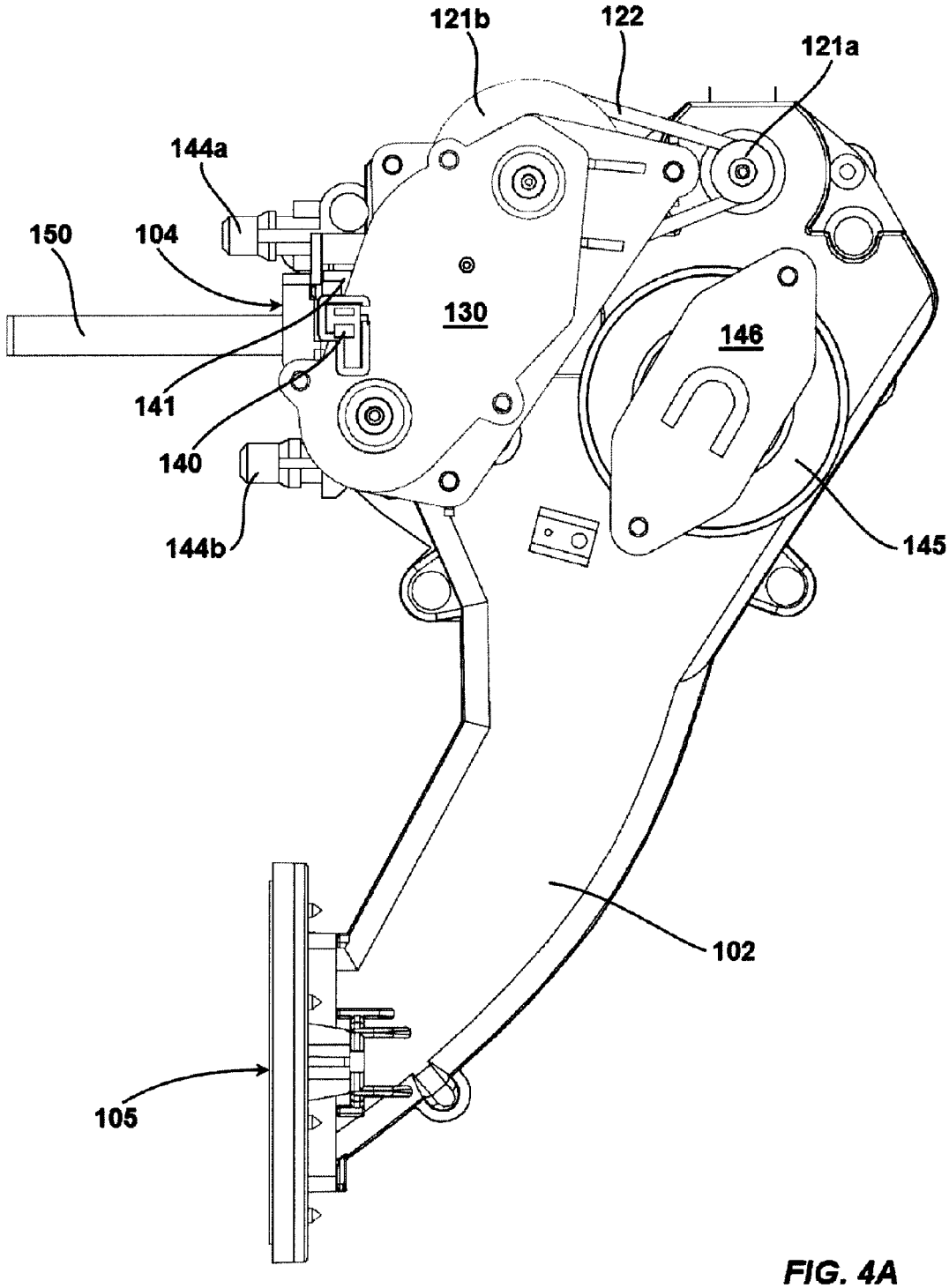
FIG. 4A is a schematic diagram showing a side view of the assembly of FIG. 1.
Figure 4B:
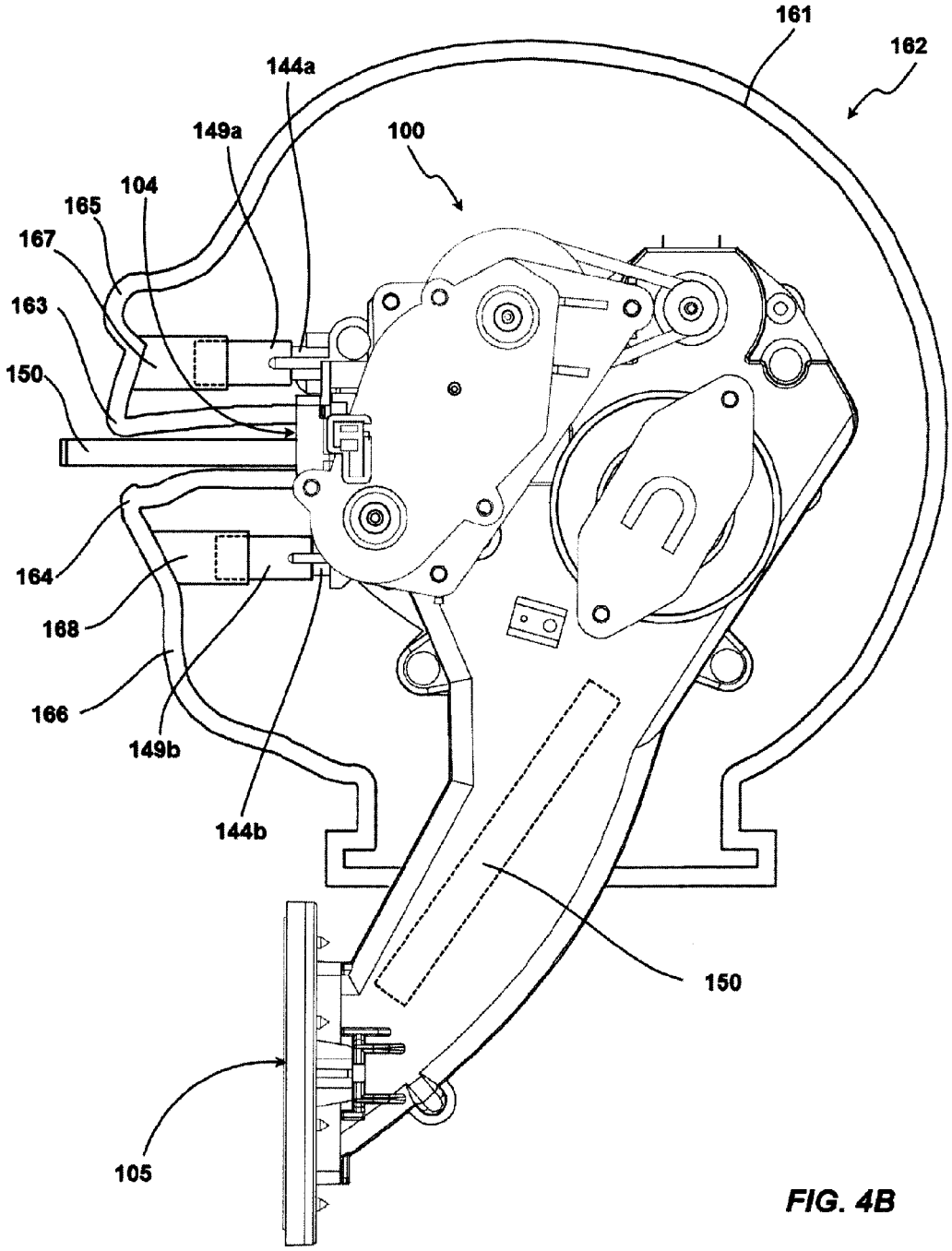
FIG. 4B is a schematic diagram showing a side view of the assembly of FIG. 1 positioned within a doll.
Figure 5:
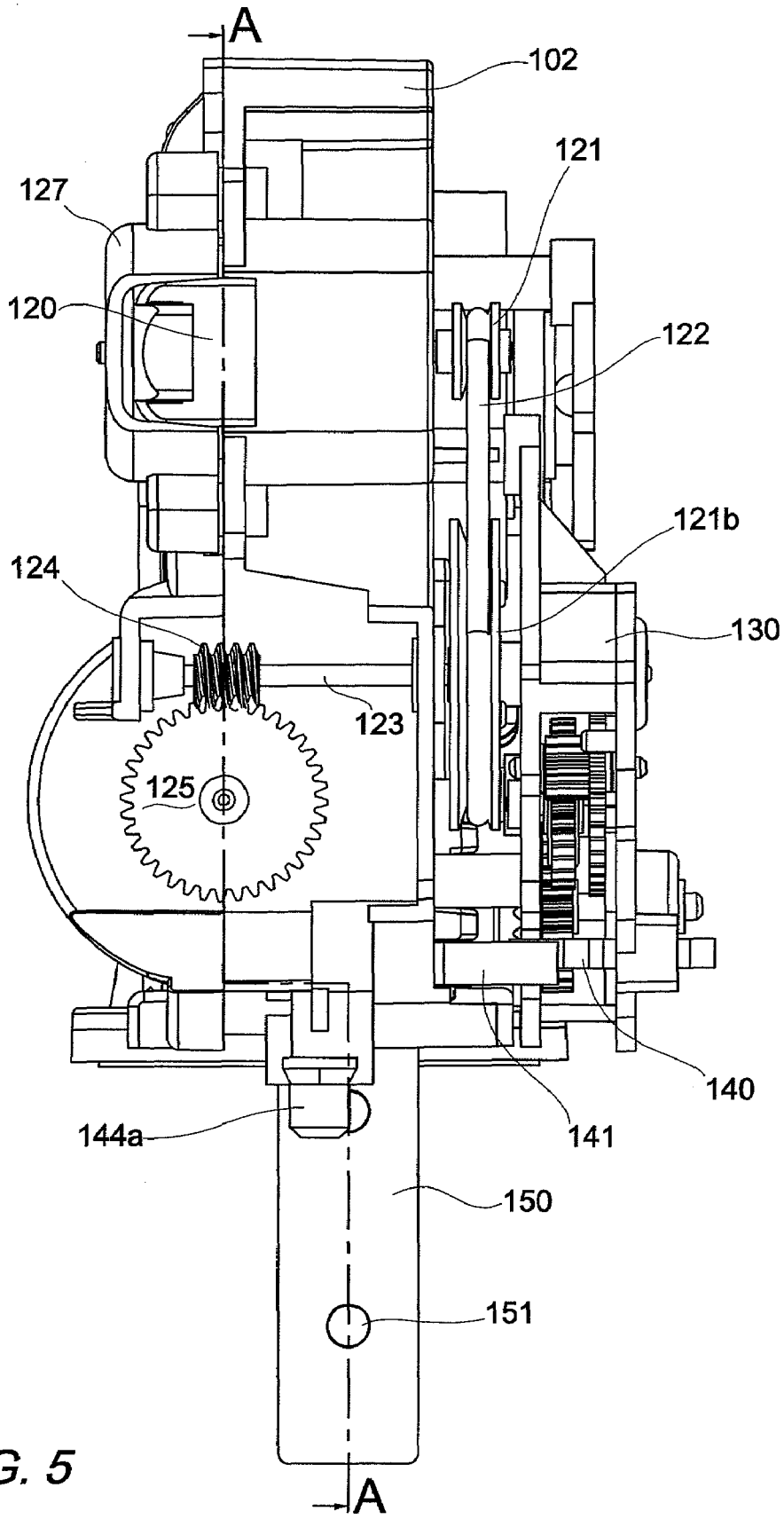
FIG. 5 is a schematic diagram showing a top view of the assembly of FIG. 1

The assembly, according to a further aspect, can comprise a speaker 145 configured to generate at least one pre-selected sound. In one aspect, the switch mechanism can be further configured to activate the speaker to generate the at least one pre-selected sound in response to sensing the selectively magnetized article. In one particular aspect, as can be seen in FIGS. 1, 4A and 4B, a speaker cover 146 can be provided to cover the speaker and keep the speaker in place. In one aspect, the speaker 145 is positioned exterior to the conduit 102 such as shown in FIGS. 1-6. One or more holes 147 can be formed in a portion of the wall 101 of the conduit, such as shown in FIG. 6. As can be appreciated, the one or more holes can be configured to allow the sound generated from the speaker to be transmitted into the conduit. Optionally, the one or more holes can be omitted and the thickness of the wall 101 can be selected to allow sufficient sound from the speaker to be transmitted therethrough the wall into the conduit. As will be described further below, in one aspect, the sound can be transmitted into the conduit such that the sound can appear to emanate from within the lumen and can be transmitted out of the lumen via the inlet.

In one aspect, the assembly can further comprise means for providing power to the electrical or electromechanical components of the assembly, including but not limited to the motor and/or the speaker. For example, in one aspect, a power source comprising one or more batteries can be provided and can be in electrical communication with the electrical or electromechanical components of the assembly.

As described throughout, portions or components of the exemplary assemblies described herein can be formed from various known materials and can be formed according to known methods. For example, various components can be formed of plastic or polymeric materials, such as but not limited to acrylonitrile butadiene styrene (ABS), acetal (POM) homopolymer plastic, polyvinyl chloride (PVC), polypropylene copolymer (PPCO), or other plastics or polymers. Other components can be formed of various metals, rubber, or other materials. For example, the conduit can be formed from rigid or semi-rigid plastics known in the art, including but not limited to ABS. Optionally, the conduit can be formed from any rigid or semi-rigid material capable of having a magnet field transmitted therethrough. The conduit can be formed as a whole unit, or as multiple units (such as the first conduit portion 102*a* and second conduit portion 102*b* shown in FIG. 2), through known extrusion, stamping, molding, or other techniques known in the art. Thus, the assembly and its various components can comprise various materials and can be formed according to various known techniques and is not intended to be limited to those materials and/or techniques described herein.

According to various aspects, exemplary assemblies as described herein can be configured to be positioned in a doll. With reference to FIGS. 3B and 4B, for example, the doll 160 can comprise a head portion 162 having a mouth, and a body portion 170 connected to the head portion. In one aspect, a skull 161 can be provided to encase at least a portion of the assembly 100; the skull can be positioned within the head portion of the doll such as shown in FIG. 4B. The mouth of the doll can comprise a lower lip 164 and an opposed upper lip 163. As can be appreciated, the doll can further comprise a nose 165 and a chin 166. In one aspect, the assembly 100 can be positioned at least partially within the head portion 162 of the doll 160. When the assembly is positioned therein the doll, the inlet 104 is positioned proximate the mouth of the doll, such as shown in FIG. 4B. Although shown in FIGS. 3B and 4B as a doll having a human form, as discussed above, the doll is not intended to be limited to a human form, but can be in animal form, in the form of a surreal creature, or any other form.

The assembly, in one aspect, further comprises means for articulating the lower lip 164 to and through a first position, in which the lower lip is spaced from the upper lip 163, and a second position, in which the lower lip is proximate the upper lip. In one aspect, the switch mechanism, such as described above, is configured to activate the means for articulating the lower lip in response to sensing the selectively magnetized article when a portion of the selectively magnetized article is inserted through the inlet into the lumen. The means for articulating the lower lip, in one aspect, comprises a lower lip lever 142, such as shown in FIG. 7. In one aspect, the motor can be in operative communication with the lower lip lever, such as through a series of gears 132 positioned within a gear box 130. When the motor is activated, such as described above for example, the series of gears 132 cooperate to move the lower lip lever. As shown in FIGS. 3A and 6, the lower lip lever 142 can be mounted on a cam gear 131, having a geared head portion, and a shaft extending therefrom that is offset from a central axis of the geared head portion. Thus, as the geared head portion of the cam gear is engaged, it causes the shaft to move about the central axis at a radial distance from the central axis, thereby effecting the movement of the lower lip lever 142.

As can be seen in FIGS. 2 and 3A, for example, the lower lip lever 142 comprises a projection 144*b*, that is configured for matable connection with a lower lip connector 149*b*, such as shown in FIG. 4B. The lower lip connector 149*b* can be configured to provide attachment means between the head of a doll and the assembly. For example, sockets, such as a nose socket 167 and a lower lip socket 168 can be formed on the inside of the doll's head 160 (or skull 161) that project inwardly. The lower lip socket can be configured to matably attach to the lower lip connector 149*b* as shown in FIG. 4B. As the lower lip lever 142 moves, the projection 144*b* and lower lip connector 149*b* move. As can be appreciated, with the lower lip connector attached to the head of the doll proximate the lower lip, for example, the movement of the lower lip connector will cause the lower lip of the doll to move to and through the first and second positions described above, thereby simulating a chewing motion.

In one aspect, the assembly can further comprise a second projection 144*a* that extends from the conduit above the inlet 104, such as seen in FIG. 4B for example. An upper lip connector 149*a* can be configured to provide additional attachment means between the head of the doll and the assembly. For example, the upper lip connector can be configured for matable attachment with the second projection and the nose socket 167. The assembly can thus be securably attached to the head portion of the doll.

In one aspect, the speaker 145 as described above, is configured to generate at least one pre-selected sound. For example, the pre-selected sound(s) can include chewing noises, swallowing noises, or verbal exclamations such as "Mmmm!", "Yummy!", "Delicious!" or other such exclamations. As described above, one or more holes 147 can be provided in a side wall of the conduit 102 to allow the sound generated by the speaker to be transmitted into the lumen. In this manner, the sound can appear to emanate from within the lumen and can be transmitted out of the lumen via the inlet. Thus, the doll can appear to be speaking or making the noises described above. The pre-selected sounds are not intended to be limited to those described above, but can include any pre-selected sound.

The switch mechanism can be configured to activate one or more components of the assembly, such as the motor and/or the speaker. The motor 120, as described above, can be in operative communication with the at least one magnetic source (such as the disk 111) and the lower lip lever 142. When the switch mechanism senses the insertion of the selectively magnetized article into the lumen via the inlet, the switch mechanism can be configured to simultaneously activate the motor (and thus the disk and the lower lip lever) and the speaker. As can be appreciated, the doll can thus simulate the chewing of the selectively magnetized article as the lower lip articulates to and through the first and second positions described above. As the selectively magnetized article is drawn into the lumen, the doll can simulate swallowing of the selectively magnetized article. The speaker can be configured to generate exemplary pre-selected sounds such as described above to enhance the simulated chewing and swallowing of the selectively magnetized article.

The doll, in one aspect, comprises a receptacle 171. The receptacle can be positioned within the body portion 170 of the doll, such as shown in FIG. 3B (or FIG. 14 for example). The outlet 105 of the conduit can be configured to be in flow communication with the receptacle. Thus, as the selectively magnetized article 150 is urged through the lumen 108 toward the outlet, the selectively magnetized article can be urged to pass through the outlet into the receptacle. In one aspect, the portion of the conduit proximate the outlet can be positioned therein the receptacle such that the selectively magnetized completes its travel at the outlet and can be directly accessed by a user to retrieve the selectively magnetized article. Thus, the receptacle and/or the outlet can be accessible from the exterior of the doll. For example, the doll can be outfitted with a bib, shirt, dress, or other clothing article or accessory that can be removably attached or lifted to allow the user to access the receptacle and/or the outlet. A user of the doll can remove or lift the clothing article or accessory to access the receptacle and remove the selectively magnetized article.

Optionally, the receptacle can be positioned elsewhere within the doll, such as proximate a back surface of the body portion of the doll. In a particular aspect, the doll can be outfitted with a knapsack or backpack, a portion of which can comprise the receptacle. As described above, the conduit can define a lumen having any shape, which may be dependent on the need or desire to have the inlet and the outlet in specific respective positions. According to various other aspects, the doll may not comprise a receptacle and the outlet can be in flow communication with the exterior of the doll such that the selectively magnetized article passes through the lumen and directly out of the doll. Optionally, as described above, the receptacle can be configured to receive the portion of the conduit proximate the outlet such that the selectively magnetized article passes through the lumen and directly out of the doll.

Figure 14:
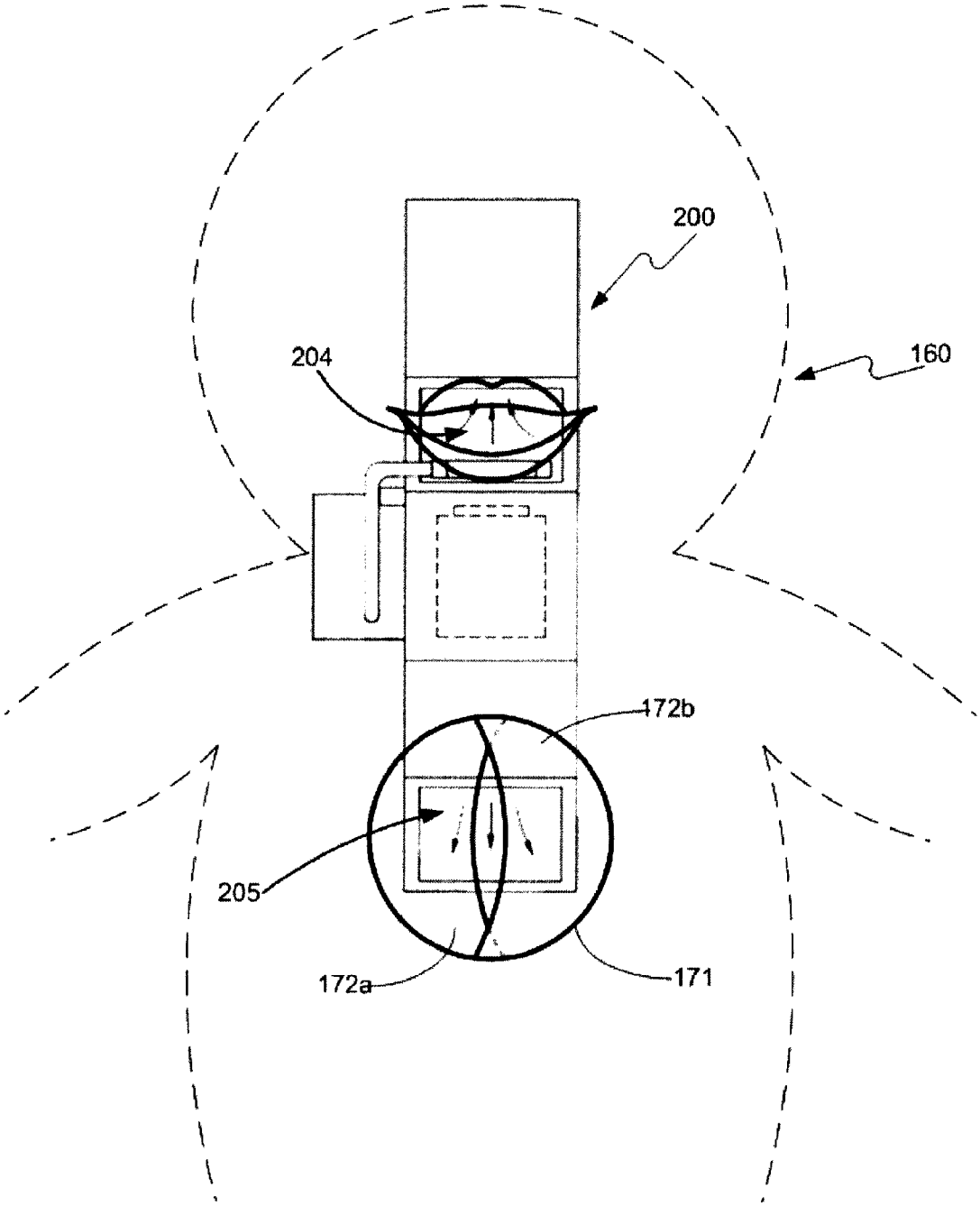
FIG. 14 is a schematic diagram showing a front view of the assembly of FIG. 9 positioned within a doll.
Figure 15A:
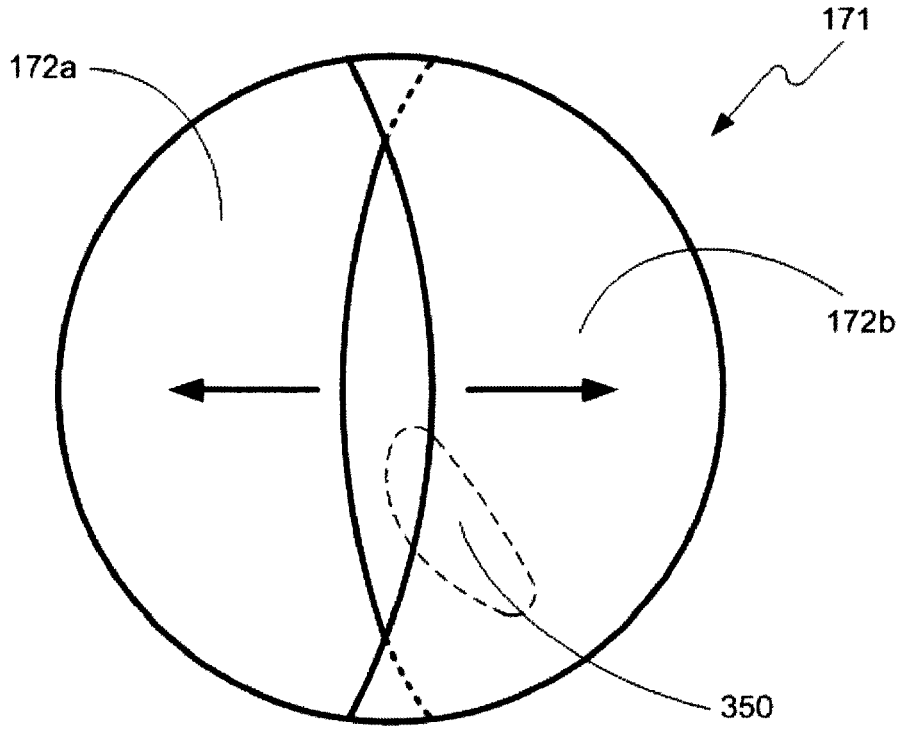
FIG. 15A illustrates a receptacle of the doll of FIG. 14 having covering members in a substantially closed position.
Figure 15B:
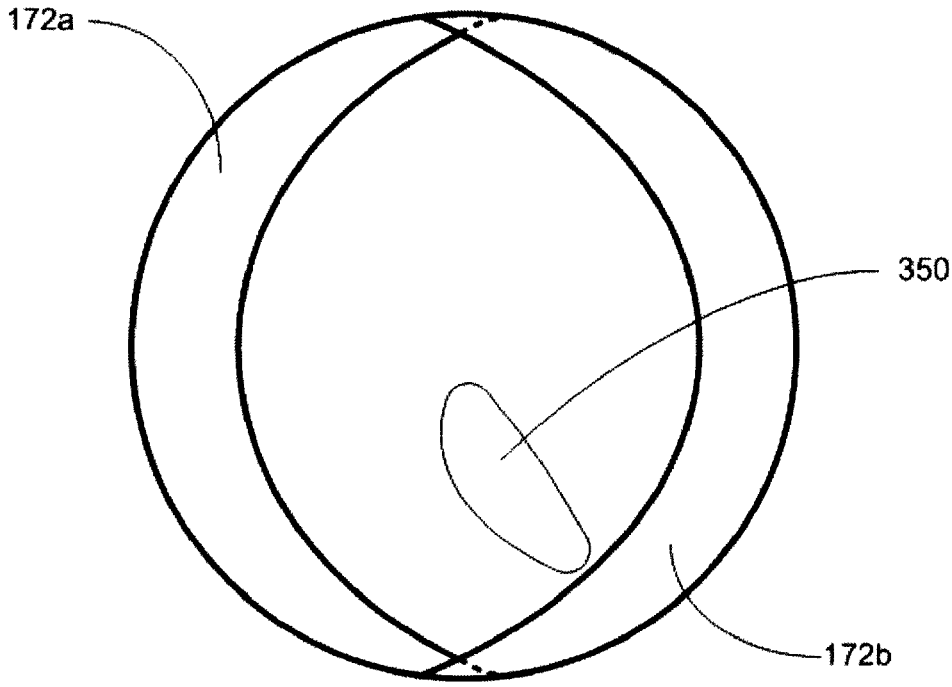
FIG. 15B illustrates the receptacle of FIG. 15A having covering members in a substantially opened position.

In yet another aspect, the receptacle 171 can be covered by one or more covering members for containing the selectively magnetized article after it has passed through the lumen, and before it has been retrieved by a user. For example, as illustrated in FIGS. 3B and 14, the receptacle can be partially covered by a first covering member 172*a* and a partially covered by a second covering member 172*b*. The covering members can partially overlap each other, as shown in FIGS. 15A and 15B for example. The covering member can then be spread apart or separated to enable access to the receptacle or outlet, such as illustrated in FIG. 15B. For additional accessibility, the covering members can be formed from a cloth-like material, including both stretch and non-stretch materials.

An exemplary selectively magnetized article 150, in one aspect, can comprise at least one metal (or magnetic) insert 151 configured to be magnetically engaged by the at least one magnetic source when the selectively magnetized article is positioned proximate the inlet and/or within at least a portion of the lumen. In a particular aspect, the selectively magnetized article 150 is substantially elongate and comprises a proximal portion, a distal portion, and a medial portion that extends between the proximal and distal portions. Optionally, the selectively magnetized article can be of any shape that can be passed through the lumen of the conduit. It is contemplated that the selectively magnetized article can be formed from a rigid material, a semi-rigid material, or a substantially flexible or pliable material, and is not intended to be limited. In one aspect, the rigidity of the selectively magnetized article can be selected to ensure that the selectively magnetized article can be drawn into the lumen and pass through the lumen from the inlet to the outlet without getting stuck within the lumen.

The metal insert(s) 151 can be disposed within the proximal portion, the distal portion, and/or the medial portion of the selectively magnetized article 150. In one aspect, more than one metal insert can be provided. For example, and not meant to be limiting, three metal inserts can be provided: a first metal insert can be disposed within the proximal portion of the selectively magnetized article, a second metal insert can be disposed within the medial portion, and a third metal insert can be disposed within the distal portion. It is contemplated that any number of metal inserts, including only one insert, can be disposed within the selectively magnetized article. For example, in one aspect, a single elongate metal insert can be disposed within and can extend along a portion of the length of the selectively magnetized article. It is also contemplated that one or more metal inserts can be disposed within one or more portions of a non-elongate selectively magnetized article, including a central portion thereof.

In a particular aspect, at least one metal insert 151 can be disposed within the proximal portion of an elongate selectively magnetized article 150. It is contemplated that as the proximal portion of the selectively magnetized article is positioned proximate the inlet 104, the metal insert disposed within the proximal portion can be magnetically engaged by the at least one magnetic source (such as a disk 111 having one or more magnets 112 positioned therein). As discussed above, in one aspect, as the selectively magnetized article is inserted into the inlet, a switch 140 can be tripped, causing the motor 120 to begin moving the disk 111. For example, the selectively magnetized article can contact the first arm of a mouth activating lever 141, causing the mouth activating lever to pivot about its pivot point, thereby causing the second arm of the mouth activating lever to contact the switch 140.

As described above, in one aspect, the lower lip lever is configured to begin moving when the selectively magnetized article is positioned proximate the inlet or inserted into the lumen (for example, when the switch is tripped). Thus, the doll 160 can appear to be chewing the selectively magnetized article 150 as it is attracted further into the lumen by the at least one magnetic source. According to various aspects, the selectively magnetized article 150 can be designed to resemble a food item, such as a vegetable, fruit, snack item, candy, etc. In a further aspect, the selectively magnetized article can be elongate. For example, an elongate selectively magnetized article can resemble an elongate candy item such as a licorice stick, a piece of spaghetti, an apple slice, a slice of cake, a wafer cookie or cracker, a carrot or celery stick, a French fry, or other food items. Optionally, the selectively magnetized article can be of any shape and can be designed to resemble any food item, and is not intended to be limited to an elongate shape that only resembles elongate food items.

The assembly 100 in one aspect can comprise a power source, such as but not limited to one or more batteries, as described above. In one aspect, the power source can be positioned within the doll such that it is generally inaccessible to the user, but can be accessed if the power source needs to be replaced. For example, a pouch can be formed within the body of the doll, such as within the body portion of the doll, into which a battery pack can be inserted. The pouch can be selectively sealed (such as, but not limited to, with a zipper, Velcro®, snap fasteners, buttons, or other such sealing or fastening means) such that it is inaccessible when the doll is in general use. When the power source needs to be replaced, it can be accessed by opening the sealing or fastening means.

Figure 9:
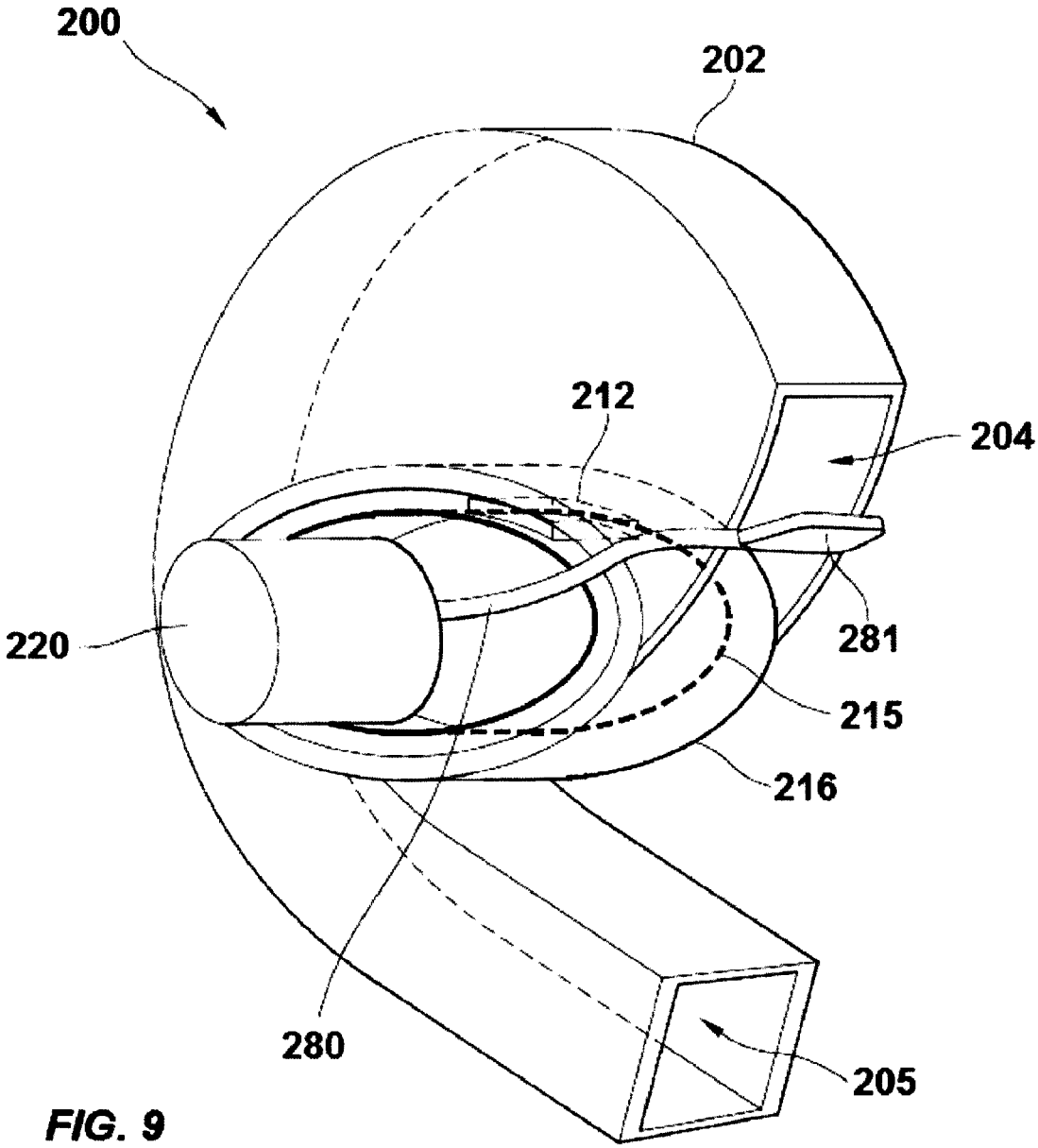
FIG. 9 is a schematic diagram showing a perspective view of an assembly for moving a selectively magnetized article, according to another aspect.
Figure 10:
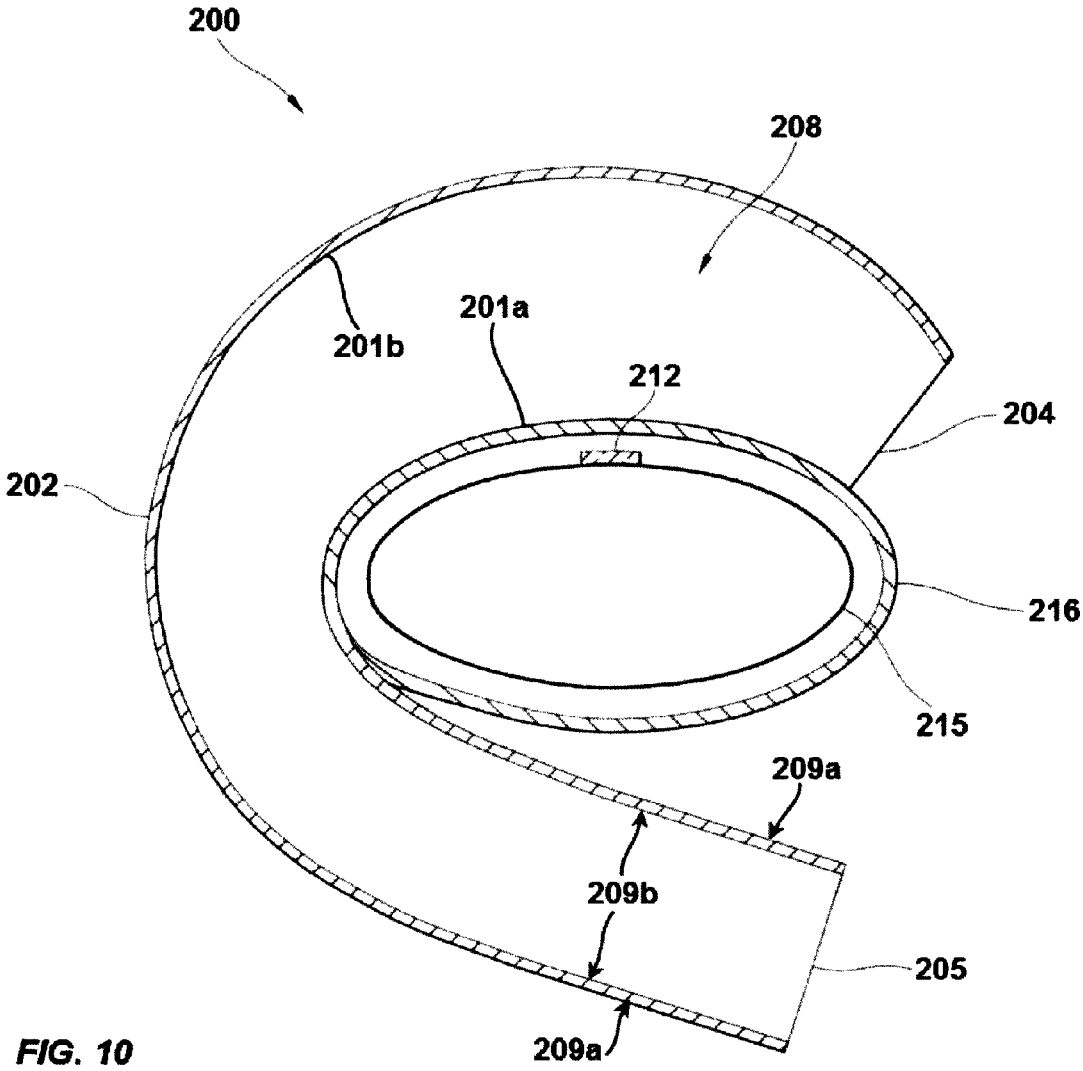
FIG. 10 is a schematic diagram showing a side, cross-sectional view of the assembly of FIG. 9.

According to various other aspects, an assembly 200 such as shown in FIGS. 9-14 can be provided for moving a selectively magnetized article. Similarly as described above, the assembly 200 can comprise a conduit 202 comprising a wall 201 having an exterior surface 209*a* and an inner surface 209*b*, an inlet 204 and an opposed outlet 205. The inner surface of the conduit defines a lumen 208 extending between the inlet and the outlet. The conduit, in one aspect, can define a generally non-linear lumen such as an arcuate lumen, or can have any other shape. For example, with reference to FIG. 10, a conduit can have a generally arcuate cross section in a plane that bisects the inlet and outlet and extends through a medial portion of the lumen. As can be seen in FIG. 10, the wall of a conduit having such a cross section can comprise a first wall portion 201*a* and a second wall portion 201*b*. In one aspect, the first wall portion extends from the inlet to the outlet for a first distance and the opposing second wall portion extends from the inlet to the outlet for a second distance. In a particular aspect, the first distance is less than the second distance.

Figure 11:
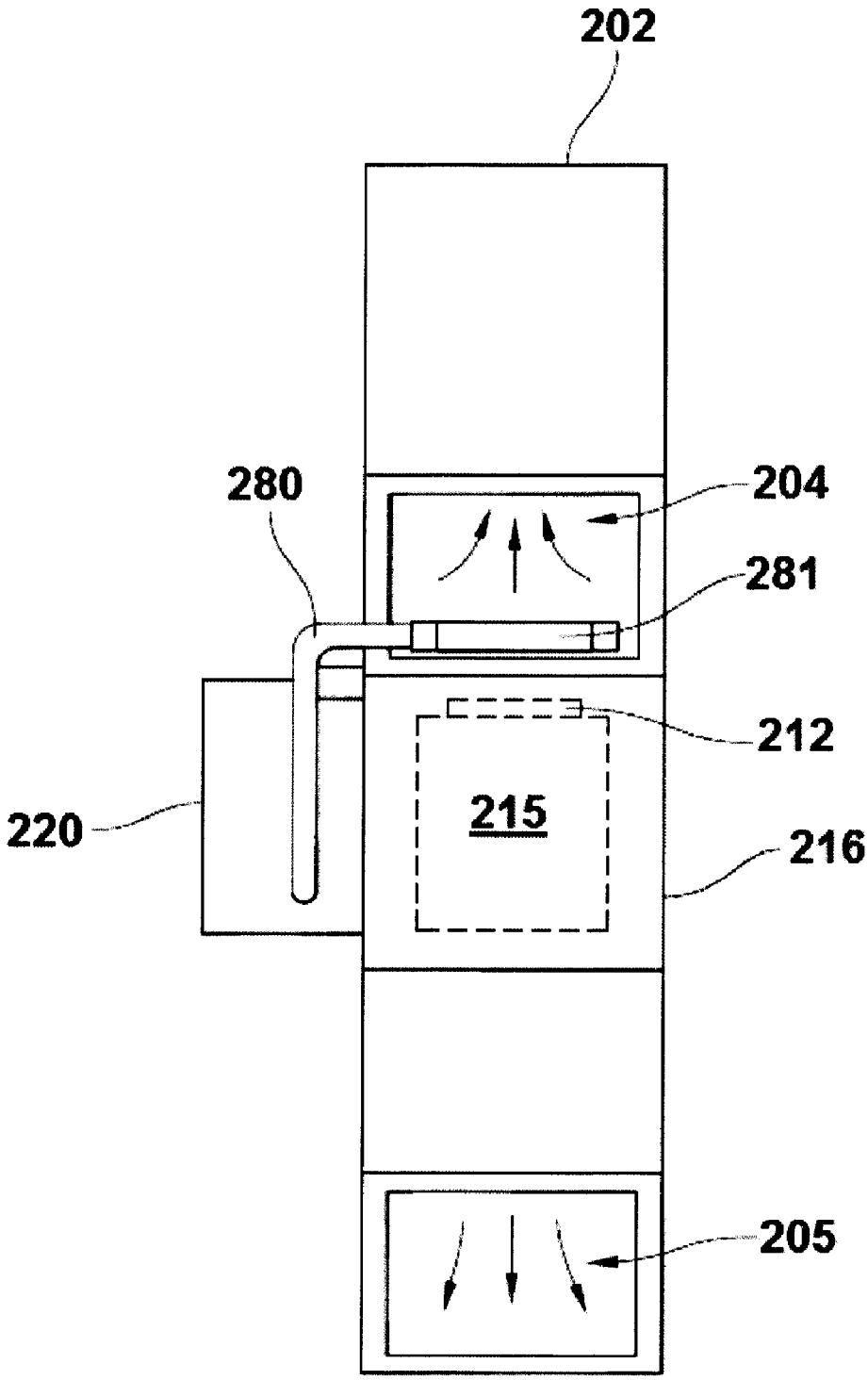
FIG. 11 is a schematic diagram showing a front view of the assembly of FIG. 9.

Similarly, the conduit 202 can define a lumen having various cross-sectional shapes. For example, as shown in FIG. 11, the cross-sectional shape of the lumen 208 can be substantially rectangular. Optionally, the cross-sectional shape of the lumen can be square, oblong, elliptical, circular, or other shape. As can be appreciated, the cross-sectional shape of the lumen can vary in size and/or shape from the inlet 204 to the outlet 205.

Figure 12:
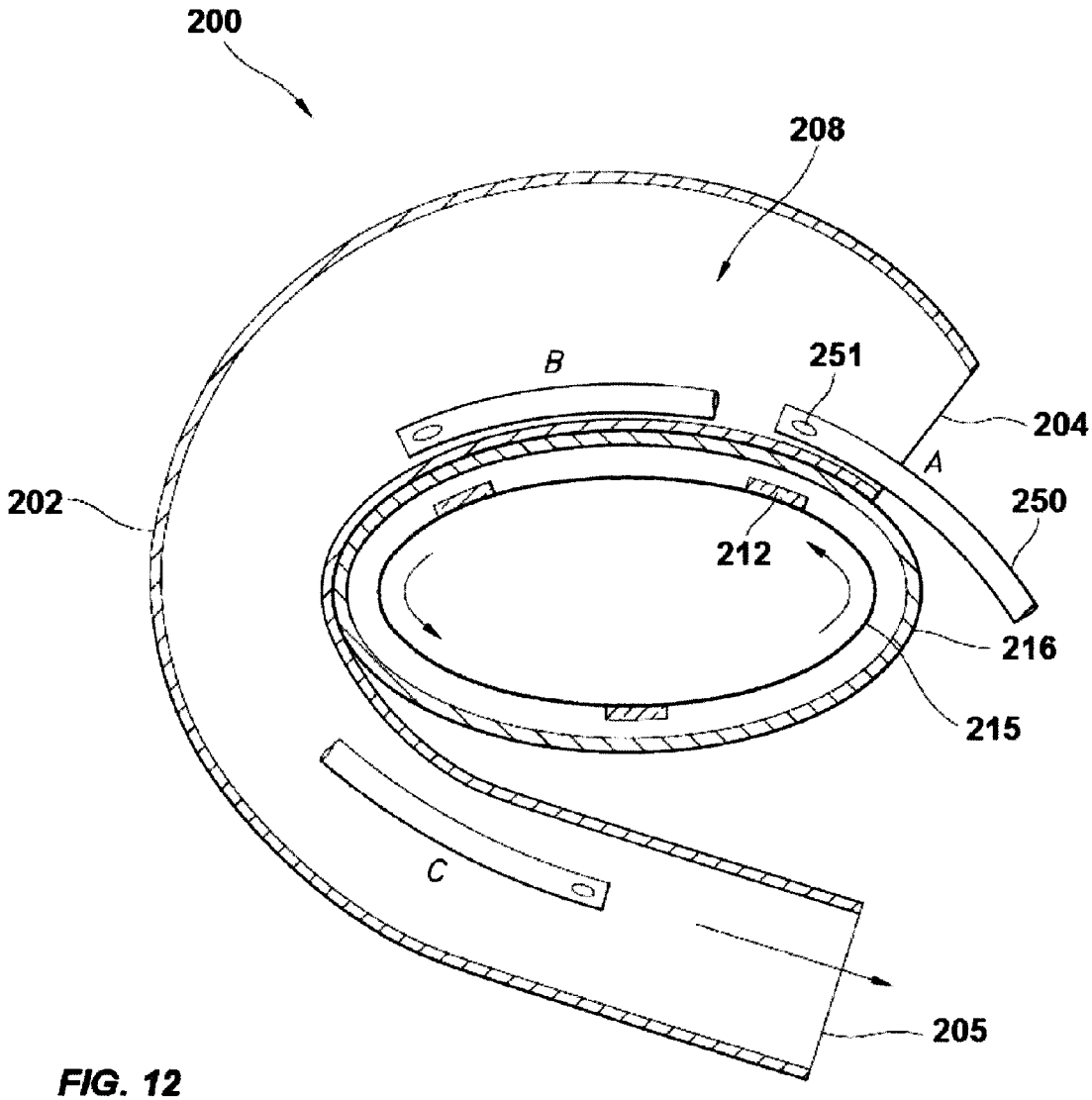
FIG. 12 is a schematic diagram illustrating movement of a selectively magnetized article by and through the assembly of FIG. 9.

In a further aspect, the assembly 200 can comprise at least one magnetic source. The at least one magnetic source can be positioned proximate a portion of the exterior surface 209*a* of the conduit. According to a further aspect, the at least one magnetic source can be selectively positioned proximate the first wall portion 201*a*. In yet another aspect, the at least one magnetic source can be selectively positioned proximate a different portion of the exterior surface of the conduit. The magnetic source can be configured to transmit a magnetic field into at least a portion of the lumen 208. As shown in FIG. 10, for example, the at least one magnetic source can comprise at least one magnet 112. The magnetic source can comprise one or more magnets, such as but not limited to two magnets, three magnets (such as shown in FIG. 12), or more magnets. A conveyor 215 can be provided on which the at least one magnet can be mounted or otherwise attached.

The assembly 200 further comprises means for moving the at least one magnetic source proximate at least a portion of the exterior surface 209*a* of the conduit. In one aspect, the means for moving the at least one magnetic source is configured to urge the magnetic source along a first path from a first position proximate the inlet toward a second position spaced from the inlet. In a particular aspect, the first path can parallel at least a portion of the exterior surface. For example, if the at least one magnetic source is positioned proximate the first wall portion 201*a*, the first path can parallel at least part of the first wall portion. The means for moving the at least one magnetic source can also be configured for urging the magnetic source from the second position back to the first position. In one aspect, this can be along the first path, such as in substantially the opposite direction. Optionally, this can be along a second path that differs from the first path. In this aspect, the first and second paths can substantially define an endless, closed loop path. In one aspect, the at least one magnetic source and means for moving the at least one magnetic source can be positioned exterior to the conduit.

As shown in FIG. 2, in one aspect, an endless conveyor 215 is provided that defines a closed loop path of travel for the at least one magnet 212. In this aspect, the conveyor urges the at least one magnet along at least a portion of the endless, closed loop path described above. At least a portion of the closed loop path of travel can parallel a portion of the wall of the conduit, such as shown in FIG. 10. As shown in FIG. 10, in one aspect, the conveyor 215 can be positioned at a spaced distance from the exterior surface 209*a* of the conduit 202.

In a particular aspect, a housing 216 can be provided that is configured for housing the conveyor and the at least one magnet. The housing can have a respective wall having an exterior surface. For example, in one aspect, the housing can be enclosed by a wall that is distinct from the wall 201 of the conduit. In this aspect, such as illustrated in FIG. 12, the housing can be positioned proximate a portion of the conduit. For example, as shown in FIG. 12, the housing can be positioned proximate the first wall portion 201*a*. In this aspect, the housing 216 can be shaped such that at least a portion of the wall of the housing substantially abuts at least a portion of the wall of the conduit. In this aspect, the conveyor can be configured to move the magnet(s) within the housing proximate at least the portion of the housing that abuts the conduit. In this aspect, it is contemplated that the at least one magnet (or other magnetic source) can generate sufficient magnetic energy to transmit a magnetic field through the wall of the housing and the wall of the conduit into the lumen 208.

Optionally, a portion of the wall 201 of the conduit can also form a portion of the wall of the housing, such as shown in FIG. 10. In this aspect, a portion of the wall of the conduit creates a shared separation surface between the lumen 208 and the interior of the housing 216 and thus separates the at least one magnetic source from the lumen. In one aspect, it is contemplated that the thickness of the shared separation surface can be selected to permit sufficient magnetic energy to be transmitted from the at least one magnetic source through the shared separation surface.

In one aspect, the means for moving the at least one magnetic source, such as described above, can comprise at least one motor 220. The motor can be further configured for moving one or more other components of the assembly. As can be appreciated, a battery or other power source can be provided to power the motor.

According to one aspect, the inner surface of the wall of the conduit can be substantially continuous from the inlet to the outlet. In this aspect, it is contemplated that the at least one magnetic source can be positioned exterior to the conduit. Similarly, the means for moving the at least one magnetic source can be positioned exterior to the conduit. For example, in one particular aspect, the conveyor 215, at least one magnet 212, and motor 220 can be positioned exterior to the conduit.

Figure 13:
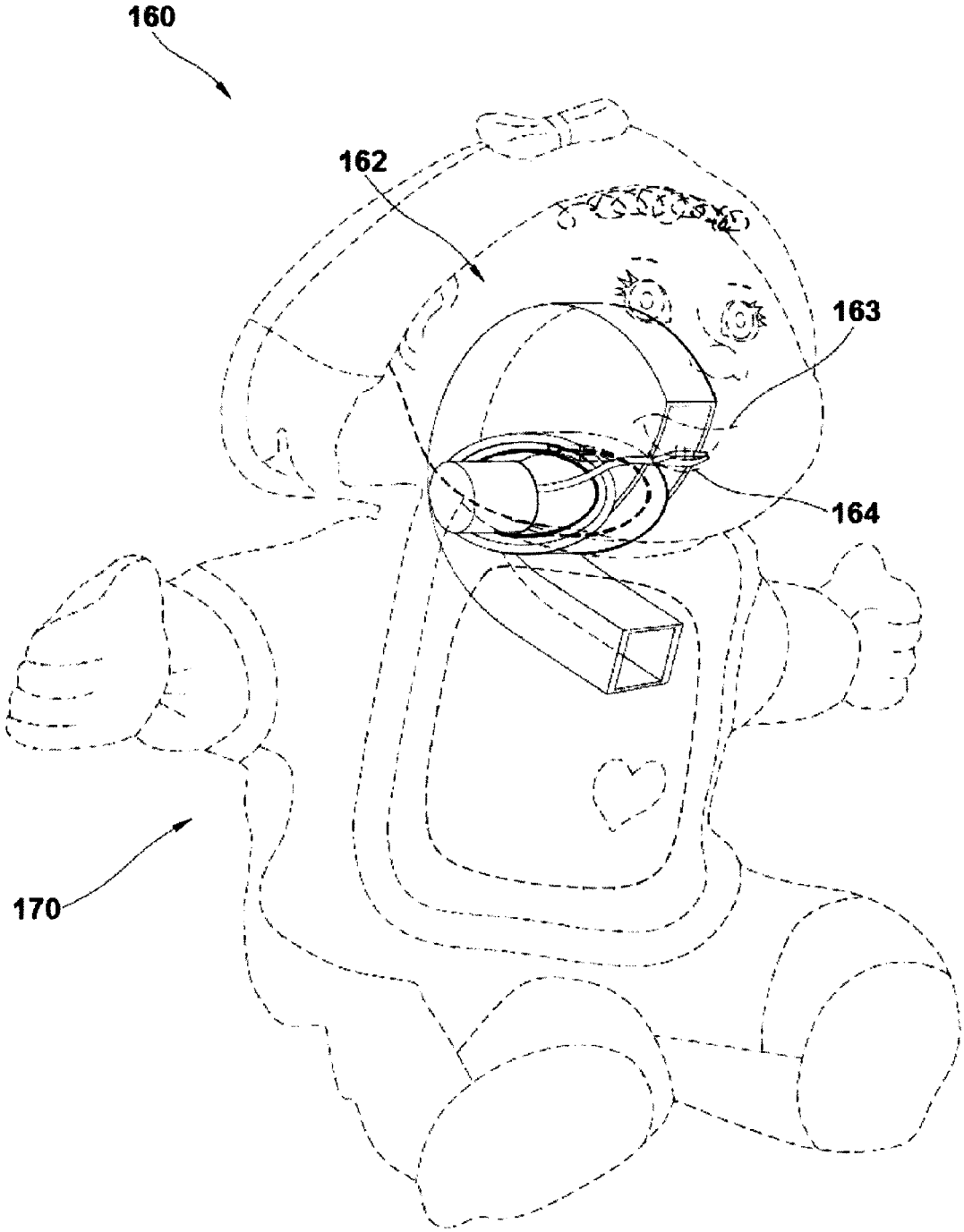
FIG. 13 is a schematic diagram showing the assembly of FIG. 9 positioned within a doll.

Similarly as described above, an exemplary assembly 200 can be configured to be positioned in a doll 160, such as shown in FIGS. 13 and 14. The assembly can be at least partially positioned within the head portion 162 of the doll with the inlet 204 proximate the mouth of the doll. In one aspect, the assembly can comprise means for articulating the lower lip of the doll. For example, in one aspect, the assembly 200 can comprise an elongate member 280 having a proximal end and a distal end, such as shown in FIG. 9. An extension 281 can extend from the distal end of the elongate member. The extension, in one aspect, is configured to extend across at least a portion of the inlet 204. The inlet generally comprises a lower portion and an opposing upper portion (such as can be appreciated from viewing FIG. 11). The assembly, in this aspect, can further comprise pivoting means for pivoting the elongate member to and through a first position in which the extension is proximate the lower portion of the inlet, and a second position in which the extension is proximate the upper portion of the inlet. As can be appreciated, when the assembly is positioned therein the doll, the extension 281 can be operatively connected to the lower lip of the doll, such that the pivoting of the elongate member causes the lower lip to move to and through a first position in which the lower lip is spaced from the upper lip, and a second position in which the lower lip is proximate the upper lip.

According to other aspects, a switch mechanism can be provided such as described above. The switch mechanism can be positioned proximate the inlet; optionally, as described above, at least a portion of the switch mechanism can extend into the lumen proximate the inlet. The switch mechanism can be configured to sense the selectively magnetized article when a portion of the selectively magnetized article is inserted through the inlet into the lumen. The switch mechanism can be configured to activate one or more electrical or electromechanical components of the assembly 200 in response to sensing the selectively magnetized article. For example, the switch mechanism can be configured to activate the motor to begin moving the conveyor. Optionally, or in addition, the switch mechanism can be configured to activate the means for articulating the lower lip. In one aspect, the motor can be in operative communication with both the means for moving the at least one magnetic source and the means for articulating the lower lip. In this aspect, when the switch mechanism senses the selectively magnetized article, the motor can be activated, thereby activating the means for moving the at least one magnetic source and the means for articulating the lower lip. Thus, as described according to various aspects herein, the doll can simulate swallowing and chewing of the selectively magnetized article when it is inserted through the mouth of the doll and inlet of the conduit into the lumen.

A selectively magnetized article can be provided, such as described above. The selectively magnetized article 250 can be substantially elongate and can be rigid, semi-rigid, or flexible, and can comprise at least one metal insert 251 disposed therein. As the selectively magnetized article is inserted through the inlet, it can trip a switch to activate the motor. With reference to FIG. 12, as the conveyor begins moving, the at least one magnet 212 will be positioned proximate the inlet at one point in its travel around the closed-loop path. At this position, it can magnetically engage the at least one metal insert therein the selectively magnetized article, and can begin to draw the selectively magnetized article into the lumen. For example, the selectively magnetized article can be drawn into the lumen and move from position A to position B.

It is contemplated that if the magnetic engagement between the at least one magnet 212 and the selectively magnetized article 250 is lost, the conveyor 215 can continue moving along its path of travel. When the magnet passes by the portion of the conduit where a metal insert of the selectively magnetized article is positioned, the at least one magnet can magnetically reengage the selectively magnetized article and continue urging the selectively magnetized article through the lumen. In a particular aspect in which more than one metal insert is disposed within the selectively magnetized article, it is contemplated that if the magnetic engagement between the magnet(s) and a first metal insert is lost, as the conveyor continues along its path of travel, the at least one magnet can magnetically engage any of the metal insets and continue urging the selectively magnetized article through the lumen. In a particular aspect, at a specific point, the path of the conveyor can cease paralleling the wall of the conduit, as can be seen in FIG. 12. At this point, the at least one magnet and metal insert 251 can disengage magnetically and the selectively magnetized article 250 can continue to pass through the lumen via gravity, such as represented by position C. Optionally, the conveyor can substantially parallel a portion of the exterior surface of the conduit through an entire length from the inlet to the outlet such that the at least one magnetic source and the selectively magnetized article are magnetically engaged until at least a portion of the selectively magnetized article passes through the outlet.

In use, a doll (such as described with regard to various aspects herein) having an exemplary assembly 100 selectively positioned therein, can be used to simulate chewing of an article. Although described below with reference to one aspect of an assembly, such as shown in FIGS. 1-6, it is contemplated that an assembly such as shown in FIGS. 9-14 can also be positioned therein a doll and used to simulate chewing of an article. A selectively magnetized article that simulates a food item, for instance, can be provided to a user of the doll (e.g., a child). The selectively magnetized article 150, in one aspect, can be elongate and can have at least one metal insert 151 disposed therein. For example, and not meant to be limiting, the selectively magnetized article can have a first metal insert disposed in a proximal portion, a second metal insert disposed in a medial portion, and a third metal insert disposed in a distal portion of the selectively magnetized article.

The user can insert the selectively magnetized article through the mouth of the doll and through the inlet 104 of the assembly 100 into the lumen 108. Upon insertion of the selectively magnetized article into the mouth, the selectively magnetized article can contact the mouth activating lever 141, thereby tripping the switch 140 and activating the motor 120. Optionally, the user can activate the assembly, such as by moving an on/off switch to its "on" position. Such an on/off switch can, in one aspect, be disposed within a portion of the doll in such a manner that it can be activated from the exterior of the doll. For example, an on/off switch can be positioned in a foot, hand, arm, abdomen, etc. of a doll (such as, but not limited to, a plush doll), such that the respective body part containing the switch can be squeezed and the switch can be activated. Optionally, the switch can be disposed on the exterior of the doll and can be manually manipulated by the user.

In yet another aspect, a mouth activating lever 141 and switch 140 can be provided as described with reference to the exemplary assembly 100 shown in FIGS. 1-6. In this aspect, an additional on/off switch can be provided such that when in the "off" position, the switch 140 cannot be tripped, thereby preventing the motor from being inadvertently activated when the doll is not being used. When a user wishes to use the doll, the user can move the on/off switch to the "on" position and can thereafter trip the switch 140 by inserting the selectively magnetized article into the mouth of the doll.

When the motor is activated, it can cause the at least one magnetic source to begin moving. For example, as described above, it can cause the disk 111 containing one or more magnets 112 to begin rotating about its longitudinal axis. As the disk rotates, one of the magnets can magnetically engage a metal insert, such as a first metal insert disposed in the proximal portion of the selectively magnetized article. As the disk continues rotating, the selectively magnetized article can be drawn into the lumen due to the magnetic engagement with at least one of the magnets 112. It is contemplated that, as the selectively magnetized article is drawn into the lumen, the magnet can become magnetically disengaged from the first metal insert. However, as the disk continues to rotate, one of the magnets can reengage the first metal insert, or can magnetically engage the second or third metal inserts disposed therein the medial portion and distal portions of the selectively magnetized article, respectively.

The user can then access the receptacle 171, or the outlet directly according to some aspects, to retrieve the selectively magnetized article. For example, the receptacle or outlet can be positioned toward the front of the doll, and can be accessed by lifting or moving a doll's shirt or bib, for example. Optionally, the receptacle can be positioned toward the rear of the doll, such as in the doll's back, or in a backpack positioned on the doll's back. However, as described above, the location of the receptacle is not intended to be limited, and the shape of the conduit (and the corresponding passageway of the lumen) can be selected to provide a passageway for the selectively magnetized article to move from the mouth of the doll to the receptacle. If the receptacle or outlet is covered with covering members (such as the covering members 172*a*, 172*b* shown in FIGS. 3B, 14, 15A and 15B, the user can separate the covering members such as shown in FIG. 15B to access the receptacle or outlet and retrieve the selectively magnetized article.

According to various aspects, the assembly, such as the exemplary assemblies described herein, can be designed to maximize the safety of a user of the doll, such as, but not limited to, a child. As described above, in one aspect, the inner surface of the conduit can be substantially continuous from the inlet to the outlet. In accordance with other aspects, various electrical, mechanical, or electromechanical components can be positioned exterior to the conduit. For example, the at least one magnetic source and the means for moving the at least one magnetic source can be positioned exterior to the conduit. In a further aspect, the means for articulating the lower lip of the doll can likewise be positioned exterior to the conduit. The conduit can further be constructed of a substantially non-porous material, such as plastic. In this manner, accidents in which a child's clothing, hair, or fingers, for example, are caught or engaged by mechanical or electromechanical components of the doll can be eliminated. Similarly, if a child pours a liquid into the conduit, such as via the inlet, electrical accidents can be substantially avoided as substantially none of the liquid would escape the conduit except via the outlet. To further increase safety aspects of the doll and the assemblies described herein, the lips of the doll and the inlet of the conduit can form a substantially continuous and uninterrupted surface (such as shown in FIG. 4B for example), such that items inserted into the mouth can only pass through the inlet and into the lumen. Thus, the user can only access the lumen and cannot access any component exterior to the conduit.

While generally described herein as being configured to move a selectively magnetized article, it is contemplated that exemplary assemblies described herein can be configured to move other articles or substances through a doll. For example, in one aspect, the inner surface of the conduit can be substantially continuous, and all electrical and electromechanical components can be selectively positioned exterior to the conduit. In this aspect, exemplary assemblies can be used to pass a liquid through the doll. In such an aspect, it is contemplated that the switch can be tripped with a cup or bottle is positioned proximate the inlet, and the means for articulating the lower lip can be simultaneously activated to move the lower lip to simulate drinking of the liquid. The liquid can pass through the lumen to the lower portion of the body portion of the doll, thereby simulating urination, for example. Because the conduit has a substantially continuous inner surface, the liquid would be prevented from contacting the electrical or electromechanical components of the doll, thereby ensuring safety for the user.

It will be apparent to those skilled in the art that various modifications and variations can be made without departing from the scope or spirit of the invention as described and embodied broadly herein. Other aspects may be apparent to those skilled in the art from consideration of the specification and practice of the invention disclosed herein. It is intended that the aspects described herein be considered as exemplary only and are not meant to be limiting.

What is claimed is:

1. An assembly for moving a selectively magnetized article within a doll, comprising:

a conduit comprising a wall having an exterior surface and an inner surface, an inlet and an outlet, wherein said inner surface defines a lumen extending between said inlet and said outlet;

at least one magnetic source selectively positioned proximate said exterior surface, wherein said at least one magnetic source is configured to transmit a magnetic field into at least a portion of said lumen and magnetically engage at least a portion of said selectively magnetized article; and means for moving said at least one magnetic source proximate at least a portion of said exterior surface, wherein said assembly is configured to attract said selectively magnetized article therethrough said inlet when said selectively magnetized article is placed in magnetic proximity of said inlet, and to move said selectively magnetized article through at least a portion of said lumen toward said outlet.

2. The assembly of claim 1, wherein said at least one magnetic source comprises at least one magnetic portion, and wherein said means for moving said at least one magnetic source is configured to urge said at least one magnetic portion from a first position proximate said inlet toward a second position spaced from said inlet.

3. The assembly of claim 1, wherein said at least one magnetic source comprises:

a substantially cylindrical disk having a longitudinal axis and a substantially planar upper surface lying in a plane substantially perpendicular to said longitudinal axis; and at least one magnet positioned therein said disk.

4. The assembly of claim 3, wherein said disk is positioned proximate said inlet and said substantially planar upper surface of said disk lies in a plane substantially perpendicular to a plane defined by said inlet.

5. The assembly of claim 3, wherein said at least one magnet is positioned such that a center of said at least one magnet lies at a radial distance from said longitudinal axis of said disk.

6. The assembly of claim 5, wherein said at least one magnet comprises two magnets, wherein each of said two magnets is positioned at a radial distance from said longitudinal axis of said disk along a common diameter of said disk and on opposing sides of said longitudinal axis.

7. The assembly of claim 5, wherein said means for moving said at least one magnetic source is configured to rotate said disk about said longitudinal axis to move said at least one magnet to and through a first position proximate said inlet and a second position spaced from said inlet.

8. The assembly of claim 1, wherein said means for moving said at least one magnetic source comprises a motor in operative communication with said at least one magnetic source.

9. The assembly of claim 1, further comprising a switch mechanism extending at least partially into said lumen proximate said inlet, wherein said switch mechanism is configured to sense said selectively magnetized article when a portion of said selectively magnetized article is inserted therethrough said inlet into said lumen and to activate said means for moving said at least one magnetic source in response to sensing said selectively magnetized article.

10. The assembly of claim 9, further comprising a speaker configured to generate at least one pre-selected sound, wherein said switch mechanism is further configured to activate said speaker to generate said at least one pre-selected sound in response to sensing said selectively magnetized article.

11. The assembly of claim 1, wherein said assembly is configured to be positioned in a doll comprising a head portion having a mouth, and a body portion connected to said head portion, wherein when said assembly is positioned therein said doll, said inlet is positioned proximate said mouth of said doll.

12. The assembly of claim 11, wherein said mouth comprises a lower lip and an opposed upper lip, and wherein said assembly further comprises means for articulating said lower lip to and through a first position wherein said lower lip is spaced from said upper lip and a second position wherein said lower lip is proximate said upper lip.

13. The assembly of claim 12, further comprising a switch mechanism extending at least partially into said lumen proximate said inlet, wherein said switch mechanism is configured to sense said selectively magnetized article when a portion of said selectively magnetized article is inserted therethrough said inlet into said lumen and to activate said means for articulating said lower lip.

14. The assembly of claim 1, wherein said selectively magnetized article is substantially elongate and comprises a proximal portion, a distal portion, a medial portion extending between said proximal and distal portions, and at least one metal insert disposed therein at least one of said proximal, distal or medial portions, wherein said at least one magnetic source is configured to magnetically engage said at least one metal insert when said selectively magnetized article is placed in magnetic proximity of said inlet.

15. The assembly of claim 1, wherein said inner surface of said conduit is substantially continuous from said inlet to said outlet.

16. The assembly of claim 1, wherein said at least one magnetic source is selectively positioned exterior to said conduit.

17. The assembly of claim 1, wherein said means for moving said at least one magnetic source is positioned exterior to said conduit.

18. A doll for simulating eating of a selectively magnetized article, comprising:

a head portion comprising a mouth having a lower lip and an opposed upper lip;

a body portion connected to said head portion;

an assembly for moving said selectively magnetized article comprising:

a conduit comprising a wall having an exterior surface and an inner surface, an inlet and an outlet, wherein said inner surface defines a lumen extending between said inlet and said outlet;

at least one magnetic source selectively positioned proximate said exterior surface, wherein said at least one magnetic source is configured to transmit a magnetic field into at least a portion of said lumen and magnetically engage at least a portion of said selectively magnetized article; and means for moving said at least one magnetic source proximate at least a portion of said exterior surface, wherein said assembly is configured to attract said selectively magnetized article therethrough said inlet when said selectively magnetized article is placed in magnetic proximity of said inlet, and to move said selectively magnetized article through at least a portion of said lumen toward said outlet, and wherein said assembly is positioned therein said doll such that said inlet is positioned proximate said mouth of said doll.

19. The doll of claim 18, wherein said at least one magnetic source comprises:

a substantially cylindrical disk having a longitudinal axis and a substantially planar upper surface lying in a plane substantially perpendicular to said longitudinal axis; and at least one magnet positioned therein said disk.

20. The doll of claim 19, wherein said disk is positioned proximate said inlet and said substantially planar upper surface of said disk lies in a plane substantially perpendicular to a plane defined by said inlet.

21. The doll of claim 19, wherein said at least one magnet is positioned such that a center of said at least one magnet lies at a radial distance from said longitudinal axis of said disk.

22. The doll of claim 21, wherein said means for moving said at least one magnetic source is configured to rotate said disk about said longitudinal axis to move said at least one magnet to and through a first position proximate said inlet and a second position spaced from said inlet.

23. The doll of claim 18, further comprising a switch mechanism extending at least partially into said lumen proximate said inlet, wherein said switch mechanism is configured to sense said selectively magnetized article when a portion of said selectively magnetized article is inserted therethrough said inlet into said lumen and to activate said means for moving said at least one magnetic source in response to sensing said selectively magnetized article.

24. The doll of claim 23, further comprising means for articulating said lower lip to and through a first position wherein said lower lip is spaced from said upper lip and a second position wherein said lower lip is proximate said upper lip, wherein said means for articulating said lower lip is configured to simulate a chewing motion as said selectively magnetized article is attracted into said lumen therethrough said inlet.

25. The doll of claim 24, wherein said switch mechanism is further configured to activate said means for articulating said lower lip in response to sensing said selectively magnetized article.

26. The doll of claim 23, further comprising a speaker configured to generate at least one pre-selected sound, wherein said switch mechanism is further configured to activate said speaker to generate said at least one pre-selected sound in response to sensing said selectively magnetized article.

27. The doll of claim 18, wherein said body portion comprises a receptacle, and wherein said assembly is positioned therein said doll such that said outlet is proximate said receptacle and in flow communication with said receptacle.

28. The doll of claim 18, wherein said inner surface of said conduit is substantially continuous from said inlet to said outlet.

* * * * *